US007293939B2

(12) United States Patent
Abbott et al.

(10) Patent No.: US 7,293,939 B2
(45) Date of Patent: Nov. 13, 2007

(54) INCLINED LEG FLOATING PRODUCTION PLATFORM WITH A DAMPER PLATE

(76) Inventors: Phillip Andrew Abbott, 20511 Manette Dr., Katy, TX (US) 77450; Larry Rayner Russell, 3607 Gramercy, Houston, TX (US) 77025-1320

( * ) Notice: Subject to any disclaimer, the term of this patent is extended or adjusted under 35 U.S.C. 154(b) by 24 days.

(21) Appl. No.: 11/051,691

(22) Filed: Feb. 4, 2005

(65) Prior Publication Data

US 2005/0175414 A1 Aug. 11, 2005

Related U.S. Application Data

(60) Provisional application No. 60/543,431, filed on Feb. 10, 2004.

(51) Int. Cl.
*B63B 35/44* (2006.01)
*E02B 17/08* (2006.01)

(52) U.S. Cl. ..... 405/196; 114/265; 405/202

(58) Field of Classification Search ..... 405/196, 405/200, 202, 223.1; 114/256, 264, 265
See application file for complete search history.

(56) References Cited

U.S. PATENT DOCUMENTS 2,398,351 A * 4/1946 Baker ..... 405/202
2,658,353 A * 11/1953 Trexel ..... 405/209
2,863,293 A * 12/1958 Plumer ..... 405/207
3,178,892 A * 4/1965 Stimson ..... 405/202
3,306,052 A * 2/1967 Kawasaki ..... 405/205
3,327,668 A * 6/1967 Von Schultz ..... 114/265
3,673,973 A * 7/1972 Glosten ..... 114/265
3,739,737 A * 6/1973 Baier ..... 114/265
3,886,613 A * 6/1975 Busch et al. ..... 14/14
3,946,684 A * 3/1976 Sumner ..... 114/265
4,147,036 A * 4/1979 Worrell et al. ..... 405/205
4,481,899 A * 11/1984 Einstabland et al. ..... 114/264
4,662,786 A * 5/1987 Cherbonnier ..... 405/195.1
5,645,259 A * 7/1997 Chen ..... 248/436
5,724,691 A * 3/1998 Wiedeck et al. ..... 14/2.4
5,846,028 A * 12/1998 Thory ..... 405/195.1
6,305,720 B1 * 10/2001 Spiering et al. ..... 285/18
6,550,740 B1 * 4/2003 Burer ..... 248/564
6,718,901 B1 4/2004 Abbott et al. ..... 114/264

OTHER PUBLICATIONS http://web.archive.org/web/20030208063706/www.grayloc.com/ultimateconnection.htm, Grayloc-The Ultimate Connection.*

* cited by examiner

*Primary Examiner*—Tara L Mayo
(74) *Attorney, Agent, or Firm*—Elizabeth R. Hall

(57) ABSTRACT

A floating moored oilfield production structure for deepwater application. An apparatus and a method for the construction and installation of floating oilfield production structures, wherein the deck structure is supported by multiple pairs of inclined buoyant legs which in turn support a subsurface damping plate structure for reducing the motions of the platform. The structure initially is initially constructed in a first configuration in relatively shallow water and then towed to a deepwater location where it is reconfigured to its operational configuration. The major structural components are joined by selectably operable pin connections.

46 Claims, 24 Drawing Sheets

25
26
27
31
32
33
34
35
36
43
44
45
46
48
70
78
79
80
84
85
88

120
18
11
45
48
48
122
42
84
123
82
78
46
70
90

200
205
101
101
101
201
18
48
12
48
42
82
84
78
43
26
70
290
18
48
48
91
293

INCLINED LEG FLOATING PRODUCTION PLATFORM WITH A DAMPER PLATE

CROSS-REFERENCE TO RELATED APPLICATION

The present application, pursuant to 35 U.S.C. 111(b), claims the benefit of the earlier filing date of provisional application Ser. No. 60/543,431 filed Feb. 10, 2004, and entitled "Inclined Leg Floating Production Platform with a Damper Plate."

BACKGROUND OF THE INVENTION

1. Field of the Invention

The invention relates to floating moored oilfield production structures for deepwater application. More particularly, the present invention relates to the apparatus and a method for the construction and installation of floating oilfield drilling and production structures, wherein the deck structure is supported by multiple pairs of inclined buoyant legs which in turn support a subsurface damping plate structure for reducing the motions of the platform.

2. Description of the Related Art

Suitable deepwater floating production platforms for the offshore oil industry are needed to permit the economical development of petroleum reserves in the increasingly deep waters in which fields are being located. Economic constraints require that the production platform have an efficient design that is installable in a completed condition on location in deep water at an affordable cost. The current platform designs, while adequate in most respects, are sufficiently expensive that many production fields are not developed.

The current state of the art for floating production platforms includes a wide variety of structural types. Semisubmersible structures such as those commonly used for drilling rigs are often utilized. While these semisubmersibles have acceptable motion responses in normal weather, their motion responses during severe storm conditions are typically excessive and unacceptable for some applications.

One production platform structure used is the tension leg platform, which has a hull roughly comparable to a semisubmersible and a vertical array of mooring tendons under high tension. However, this type of structure is quite expensive and its installation is complex. Spars are tubular structures with their axis of symmetry generally vertical. Because of their design, spars must have their deck load of production equipment installed offshore, which is a very expensive procedure.

A new production platform structure that has not been put into service yet is the extendable draft platform (EDP). This type of platform has a hull form generally resembling a semisubmersible, but with multiple large vertical parallel primary legs. The EDP has a damper plate attached to multiple legs at their lower ends. These legs extend upwardly through the deck of the structure. In shallow water, the damper plate is positioned immediately below the hull in order to provide a minimum draft. When the EDP is towed into sufficiently deep water, its damper plate can be lowered on the legs and the tops of the legs attached to the floating deck. The tops of the legs are then deballasted until the air gap between the underside of the deck and the water is sufficient for operating conditions. The EDP has the disadvantage of requiring high lifts of leg components during construction and costs that, while possibly cheaper than a spar, can still be prohibitively expensive except for relatively large production fields.

There is a need for a less expensive deepwater floating production platform with desirable wave motion response patterns, or seakeeping ability. Also, there is a need for a floating platform configuration that is relatively insensitive to vortex induced vibrations (VIV) in currents. There is a further need for a deepwater floating drilling and production platform that can be economically constructed without the use of expensive high lifts and which permits an inshore deck completion and hookup.

There is also a need for a floating platform that can have its major constituents built at a variety of locations and then the platform assembled at any selected location. Additionally, there is a need for an improved drilling and production platform that is easy to transport and erect at a chosen location.

Further, there is a need for a floating platform configuration that can be readily converted from a drilling configuration to a production arrangement. Existing platform configurations require that the platform either be made very large to accommodate both operational phases or that two separate structures be used.

SUMMARY OF THE INVENTION

One aspect of the present invention is a deepwater floating oilfield drilling and production platform with structural framing which constitutes a four-bar linkage. The preferred embodiment included a four-bar linkage having five linking pins, four of which are selectably operable. A barge-like buoyant deck section having parallel sets of multiple coaxial pin connection sockets on two of its opposed sides serves as a first bar of a linkage. Multiple similar sets of parallel pairs of similar buoyant tubular legs wherein each pin pair is pinned together at a position intermediate along the length of the legs by a permanent pin and which also have distal operable pin connections serve as two other linkage bars. Similar pins for the multiple leg pairs are equidistant from the permanent pin. A fourth bar is provided by a damper plate having a basically rectangular prismatic shape with one or more central rectangular holes and with parallel sets of multiple coaxial pin connection sockets at two of its opposed sides.

A second aspect of the present invention is an assembled structure with the legs pinned to both the deck and the damper plate, where both the deck section and the damper plate structures are horizontal. The attached legs of the leg pairs cross at their central pins and are inclined from the vertical. Following engagement of the first three operable pins of the four-bar linkage after the permanent pin has been engaged, the fifth pin is engaged to rigidize the linkage. The assembled production platform has crossed legs connecting the deck and the damper plate. In the other transverse direction, X-braces interconnect similar inclined legs of the leg pairs to stiffen the structure. The platform is supported by the buoyancy of its legs and in its operational position is ballasted so that it supports the deck at a safe operating elevation above the sea surface, while the damper plate is positioned at a sufficient depth such that the vessel motions are considerably reduced. The deck, leg, and damper plate elements of the present invention are preassembled inshore in relatively shallow, protected water. Each of the multiple pairs of legs consists of a first leg and a second leg cojoined on a common pivot axis by an intermediately located permanent pin, wherein the legs are geometrically similar.

Another aspect of the present invention is the preassembly of the individual leg pairs. The leg pairs are interconnected in parallel, spaced apart positions by the diagonal X-braces and the legs of each pair are maintained in parallel positions. Both the deck and the damper plate structure are each attached to only the first leg of each pair of legs by the upper end and lower leg end sets of pins respectively, while the leg pin connections of the other leg in each pair are left unconnected. The partially assembled production platform is then safely towable in a shallow draft condition to a deep-water location where the damper plate and legs are lowered and the platform pin connections are activated to produce a rigid operational linkage. Following the completion of the making of the final pin connections, the platform legs are deballasted so that the deck is raised to its desired operational height and the platform is moored. At this point, the platform is operational.

Yet another aspect of the present invention is a floating oilfield platform comprising: a buoyant deck; a plurality of pairs of crossed legs; a first attachment means for attaching a first end of each leg in the pair of crossed legs to the deck; a submersible damper plate; and a second attachment means for attaching a second end of each leg in the pair of crossed legs to the damper plate.

Another aspect of the present invention is a floating oilfield platform comprising: a buoyant deck mounting multiple pairs of deck pin sockets, each pair of deck pin sockets includes a first deck pin socket having a first deck bore and a second deck pin socket having a second deck bore, wherein the first deck pin sockets are mounted on a first side of the deck with coaxially aligned first deck bores and the second deck pin sockets are mounted on a second opposed side of the deck with coaxially aligned second deck bores; a plurality of leg pairs having a first leg and a second leg cojoined by a pivot pin, wherein the pivot pins of the leg pairs are coaxial; a submersible damper plate mounting multiple pairs of damper pin sockets, each pair of damper pin sockets includes a first damper pin socket having a first damper bore and a second damper pin socket having a second damper bore, wherein the first damper pin sockets are mounted on a first side of the damper plate with coaxially aligned first damper bores and the second damper pin sockets are mounted on a second opposed side of the damper plate with coaxially aligned second damper bores; and a plurality of selectably extendable pins, a pair of extendable pin mounted on a top end and a bottom end of each first and second leg of each leg pair, wherein the extended extendable pins engage the first and second deck bores and the first and second damper bores.

Still yet another aspect of the present invention is an oilfield platform attachment system comprising: a hub mounted on a structural component of an oilfield platform, the hub having a hub bore and an externally upset transverse hub flange; an attachment structure having a stabbing nose engageable with the hub bore and an externally upset transverse attachment flange, wherein the attachment flange is flush with the hub flange whenever the stabbing nose is fully engaged in the hub bore; and a split clamp engageable with the hub flange and the attachment flange whenever the attachment flange is flush with the hub flange.

Another aspect of the present invention is a method for assembling a floating oilfield platform comprising: obtaining a plurality of platform leg pairs, wherein the leg pair is comprised of a first platform leg cojoined to a second platform leg; attaching a proximal end of each first leg of the platform leg pairs to a floating platform deck; rotating the attached cojoined leg pairs underneath the platform deck; and attaching a proximal end of each second leg of the platform leg pairs to the deck.

Yet another aspect of the present invention is A method for assembling a floating oilfield platform comprising: inserting a selectably extendable pin assembly into a proximal end and a distal end of a plurality of legs; positioning a first leg and a second leg parallel to each other; joining the first and the second legs with a pivot pin to form a cojoined leg pair, wherein the first and second legs are rotatable about the pivot pin; positioning a plurality of cojoined leg pairs, wherein the first legs of the leg pairs are parallel and the second legs of the leg pair are parallel and the extendable pin assemblies in the proximal ends and the distal ends of the parallel first legs are axially aligned and the extendable pin assemblies in the proximal ends and the distal ends of the parallel second legs are axially aligned; securing a first brace to each pair of the parallel first legs; securing a second brace to each pair of the parallel second legs; attaching the distal ends of the braced parallel first legs to a first set of damper pin sockets mounted on a first side of a damper plate by extending the pin assemblies in the distal ends of the first legs into a first set of coaxially aligned through-bores of the first set of damper pin sockets; attaching the proximal ends of the braced parallel first legs to a first set of deck pin sockets mounted on a second side of a deck by extending the pin assemblies in the proximal ends of the first legs into a first set of coaxially aligned through-bores of the first set of deck pin sockets; pivoting the braced parallel second legs to angularly separate the braced parallel second legs from the braced parallel first legs; attaching the distal ends of the braced parallel second legs to a second set of damper pin sockets mounted on a second opposed side of the damper plate by extending the pin assemblies in the distal ends of the second legs into a second set of coaxially aligned through-bores of the second set of damper pin sockets; rotating the damper plate underneath the deck; aligning the proximal ends of the braced parallel second legs with a second set of deck pin sockets mounted on a second opposed side of the deck; and attaching the proximal ends of the braced parallel second legs to the second set of deck pin sockets by extending the pin assemblies in the proximal ends of the second legs into a second set of coaxially aligned through-bores of the second set of deck pin sockets; whereby the braced parallel first legs and the braced parallel second legs are inclined at opposed angles from a vertical midplane of the cojoined leg pairs.

Still yet another aspect of the present invention is a method for exchanging a floating platform deck comprising: detaching a set of first legs of a plurality of cojoined crossed leg pairs from a first platform deck; detaching a set of second legs of the plurality of cojoined crossed leg pairs from the first platform deck; attaching the set of first legs to a second platform deck; and attaching the set of second legs to the second platform deck.

The foregoing has outlined rather broadly several aspects of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

The present invention relates to a floating moored oilfield production structure for deepwater application. The present invention relates to an apparatus and a method for the construction and installation of floating oilfield drilling and production structures. The floating oilfield drilling and production structure of the present invention utilizes multiple sets of inclined buoyant legs joined by selectably operable pins to connect, support and stabilize the deck structure and a subsurface damping plate. The structure components are initially assembled and configured in relatively shallow water, and then the preassembled structure is towed to a deepwater location and reconfigured to its operational configuration.

Structural Components

The components of the main structural elements of the novel floating production platform of the present invention are typically constructed of steel. The design of the structural platform uses tubular members, stiffened shells, and stiffened plate structures commonly found in shipyard and offshore construction. Welding is the primary means of assembly for the structural components. Components, such as connecting pins, pin mountings, and pin sockets, require closer tolerances and are typically machined.

Figure 1:
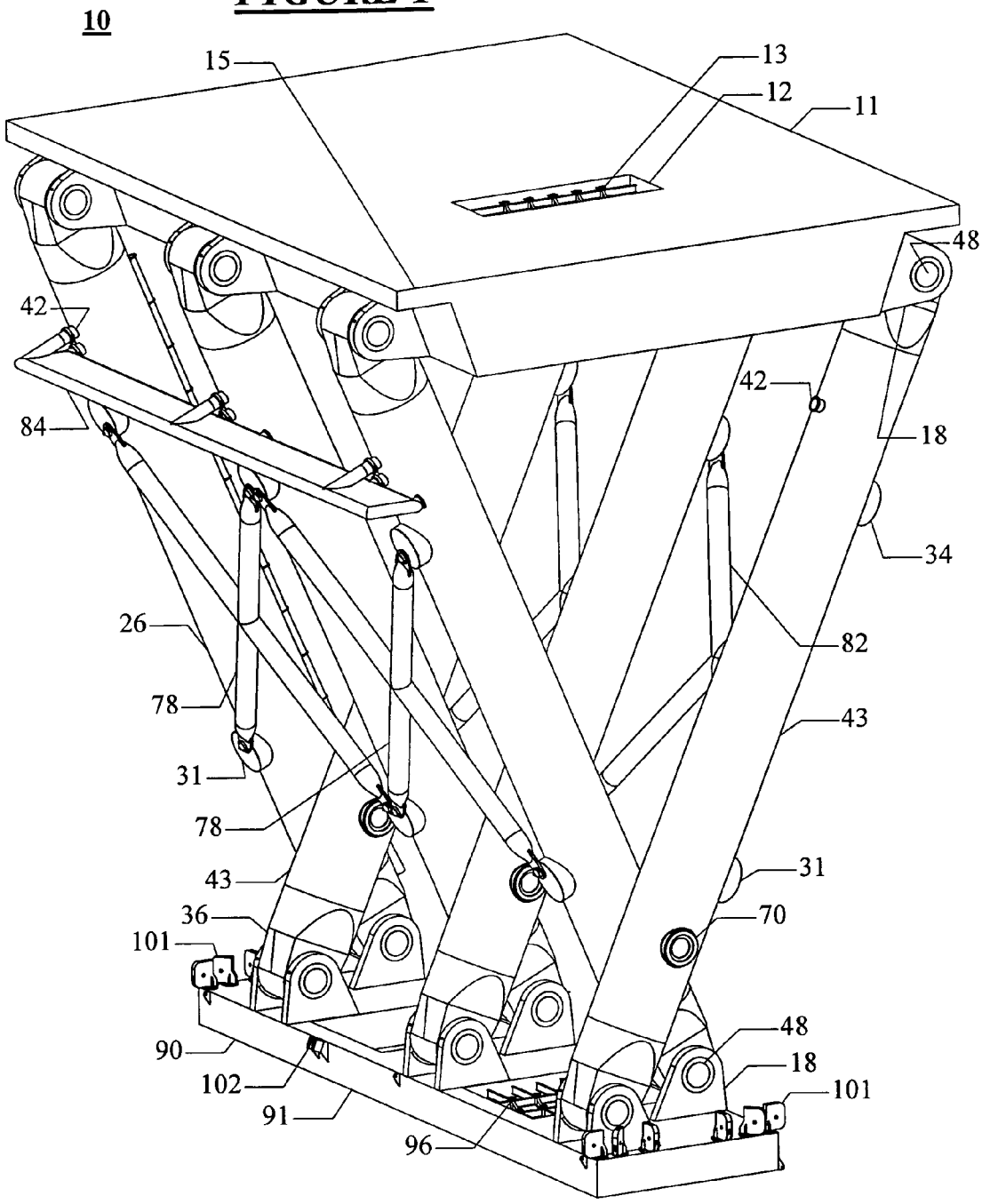
FIG. 1 is an oblique view of the first embodiment of the inclined leg floating production platform assembled and ready for deployment of its moorings, well risers, and attached pipelines.
Figure 2:
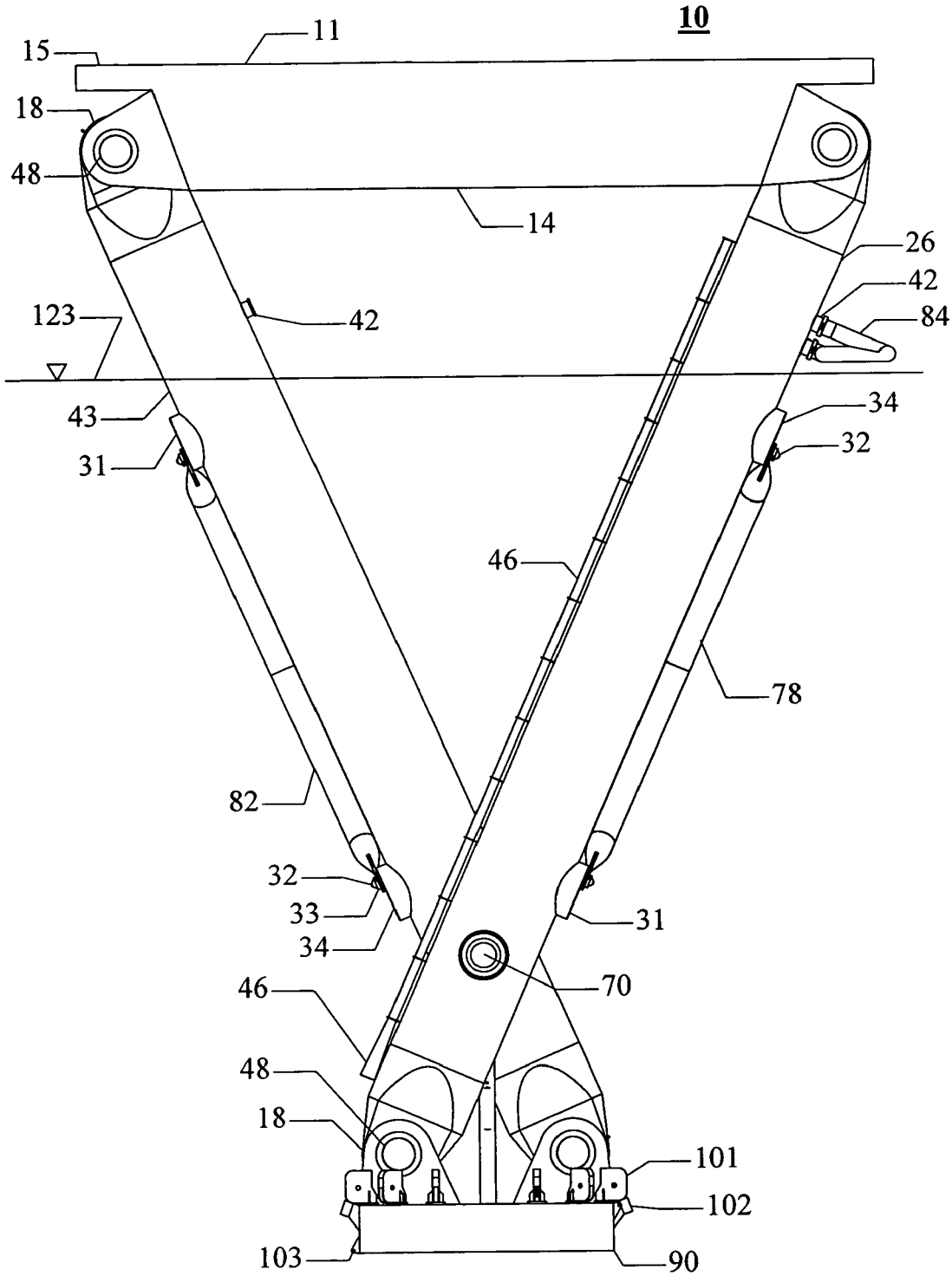
FIG. 2 is a side profile view corresponding to FIG. 1, showing the location of the operating draft water level for the platform.
Figure 3:
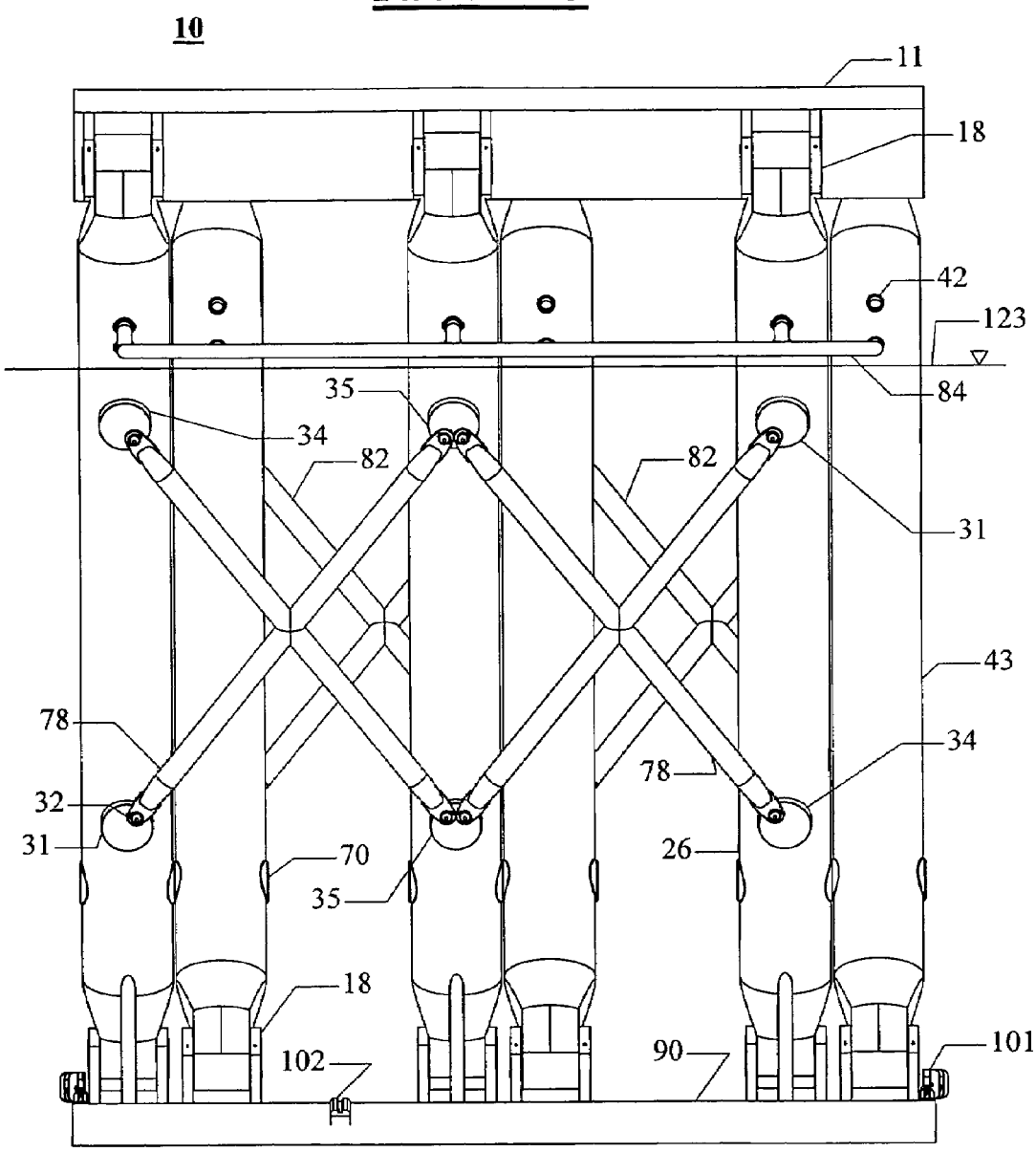
FIG. 3 is a frontal profile view corresponding to FIGS. 1 and 2 from the side of the platform on which the combination boat fender and strongback is mounted.

In FIGS. 1, 2, and 3, the general arrangement of the first embodiment of the platform 10 can be seen. A deck section 11, suitable for supporting a drilling system or a production system or a combined drilling and production system, is positioned at the upper end of the structure 10. For the purposes of illustration, the deck 11 is provided with a well conductor guide tray 13 such as would be used for a production deck arrangement.

The deck is supported by a leg system 25 comprising multiple buoyant leg pairs. Each leg pair includes similar legs 26 and 43 cojoined by a permanent pin 70 that serves as a hinge or pivot. The first leg 26 and the second leg 43 of a leg pair are laterally offset in the direction of the permanent pin axis from each other, to permit them to freely rotate relative to each other about permanent pin 70. The permanent pins 70 of the leg system 25 are coaxial; all of the first legs 26 of the leg system 25 are coplanar in a plane containing their longitudinal axes; and the second legs 43 are similarly coplanar. The platform 10 is supported by two or more leg pairs. A preferred embodiment illustrated in FIG. 1 has three leg pairs.

Selectably operable field mateable pin assemblies 48 are mounted in the upper and lower ends of each leg 26 and 43. Pin assemblies 48, which are hydraulically extensible and retractable, serve to interconnect the legs to the deck 11 and the damper plate structure 91. The leg system 25 is transversely connected and fixedly spaced apart by diagonal braces 78 and 82 in order to maintain the leg pairs mutually parallel and so that loads may be efficiently transferred between adjacent leg pairs.

The damper plate structure 91 interconnects the bottom end of the leg system 25 to rigidize the platform 10 in the planes perpendicular to the axes of the permanent pins 70. This rigidization in this primary plane is due to the formation of multiple parallel four-bar linkages. Considering the multiple leg linkages as a single aggregate linkage, the deck 11, the first legs 26, the second legs 43, and the damper plate 91 serve as the four bars. The four-bar linkage is connected with five pins including the permanent pins 70 and the field mateable pins 48. Prior to the connection of the last pin on the linkage, the linkage is not rigid. The diagonal braces 78 and 82 assist the pin connection joints formed by the field mateable pin sockets 18 with the field mateable pin assemblies 48 in maintaining the overall rigidity of the platform in the vertical secondary plane containing the axes of the permanent pins 70. Additionally, a combination boat landing and strongback 84 is used to further connect the legs 26 of the platform 10 on one side of the platform. If a combination boat landing and strongback 84 is used on the other side of the platform, it further connects the legs 43.

A. The Deck

1. The Deck Structure

Figure 5:
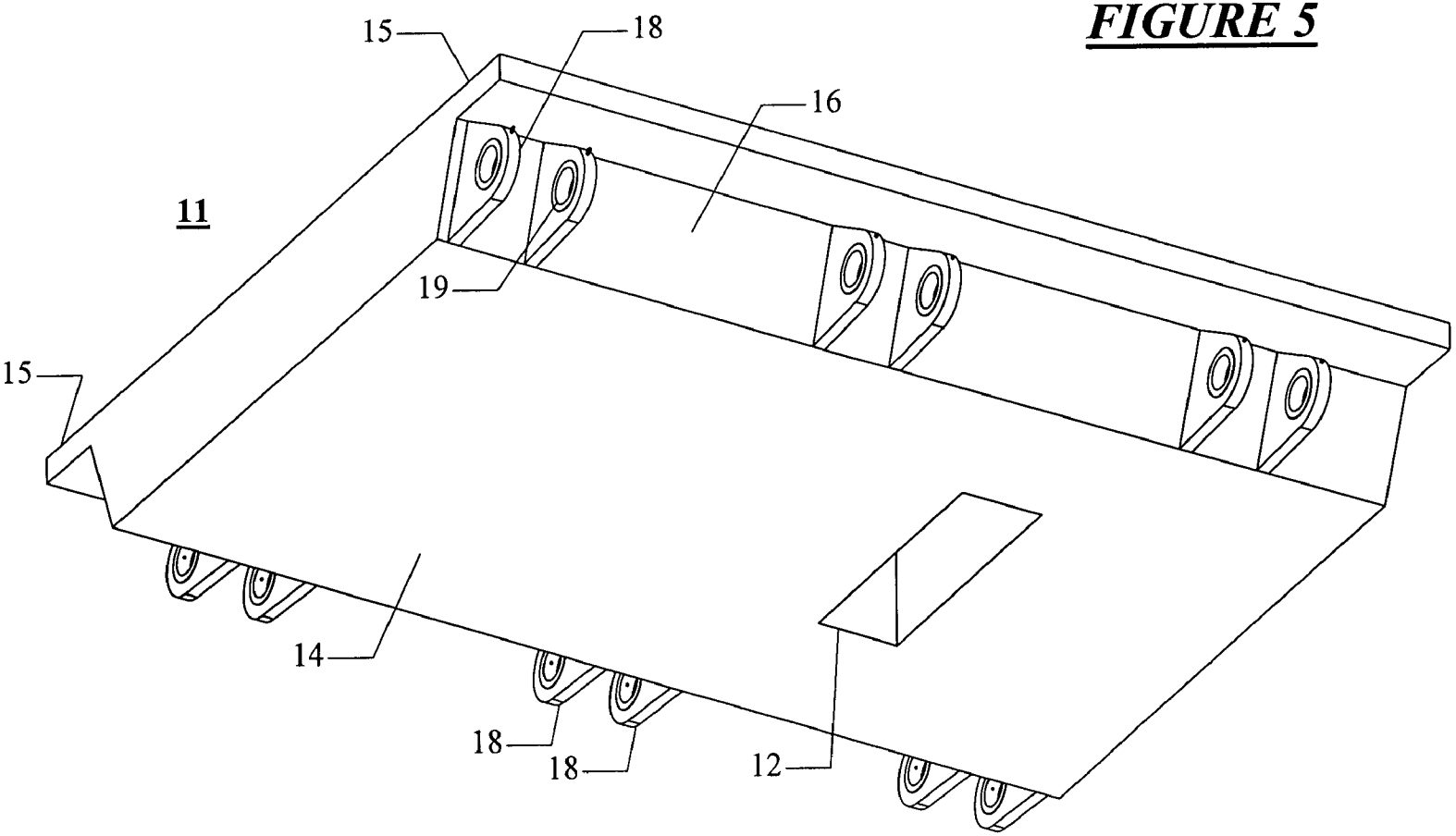
FIG. 5 is an oblique view from the underneath side of the deck structure showing the field mateable pin sockets.

FIG. 5 shows an oblique view of the lower side of the deck 11. The deck structure 11 is constructed as a buoyant barge, which is approximately square in plan view. Deck 11 has two opposed vertical sides, two pin socket mounting surfaces 16, a flat upper surface, and flat deck bottom plating 14. The pin socket mounting surfaces 16 are planar and inclined to the vertical so that the deck widens upwardly. As shown in FIG. 5, the upper deck surface is provided with optional horizontal overhangs 15 on each side above the pin socket mounting surfaces 16. The deck 11 has a vertical wall rectangular well bay 12 located in a space between adjacent pairs of field mateable pin sockets 18 and, hence, between adjacent pairs of legs 26 and 43. Typical dimensions for the deck section 11 vary depending on the application, but for the example shown here are on the order of approximately 300 feet for the horizontal rectangular side dimensions and a thickness of about 28 feet.

The deck structure 11 is constructed of stiffened flat plates with internal trusses, bulkheads, and pedestals as needed to accommodate structural loads from the leg attachments and the drilling or process equipment used in petroleum drilling and production. Some of the hull compartments in the deck 11 can be used for tankage or storage. The process equipment is not shown in FIGS. 1 to 12, but a variety of typical arrangements familiar to those skilled in the art are compatible with this type of deck construction. Additionally, the mooring winches and/or chain jacks used to manipulate the spread mooring system of the production platform are supported by the deck section 11, but for clarity are not shown. A conductor guide tray 13 consisting of a horizontal grillage of steel beams which supports multiple vertical axis tubular guides at its interior nodal points is positioned in the well bay 12 in order to support the conductors and/or risers which connect to subsea wells.

2. The Field Mateable Pin Sockets

Mounted on the pin socket mounting surfaces 16 of the deck and extending outwardly perpendicularly are a series of multiple pairs of parallel, coaxially mounted field mateable pin sockets 18 used to attach the leg ends as described in more detail below. The number and positioning of the pairs of pin sockets 18 corresponds to the number and positioning of leg ends 36 attaching to the deck 11. The sockets 18 are rigidly connected to internal supporting structures inside the deck section (not shown). Alternatively, the pin sockets 18 also may be structurally connected to the deck overhangs 15 and may be optionally provided with lateral supports in order to strengthen them for resistance to transverse loadings, as may be readily understood by those skilled in the art.

The field mateable pin sockets 18 are of identical buttress construction, having horizontal axis through bores 19 as well as side reinforcement plates around the bores. All of the bores 19 of the sockets 18 on each pin socket mounting surface 16 are coaxial. Although the number of pin sockets will vary with the number of leg systems used in the structure, a preferred embodiment shown in the drawings has three pairs of pin sockets 18 on each side of the deck 11 to accommodate the three leg pairs of the leg system 25.

Figure 16:
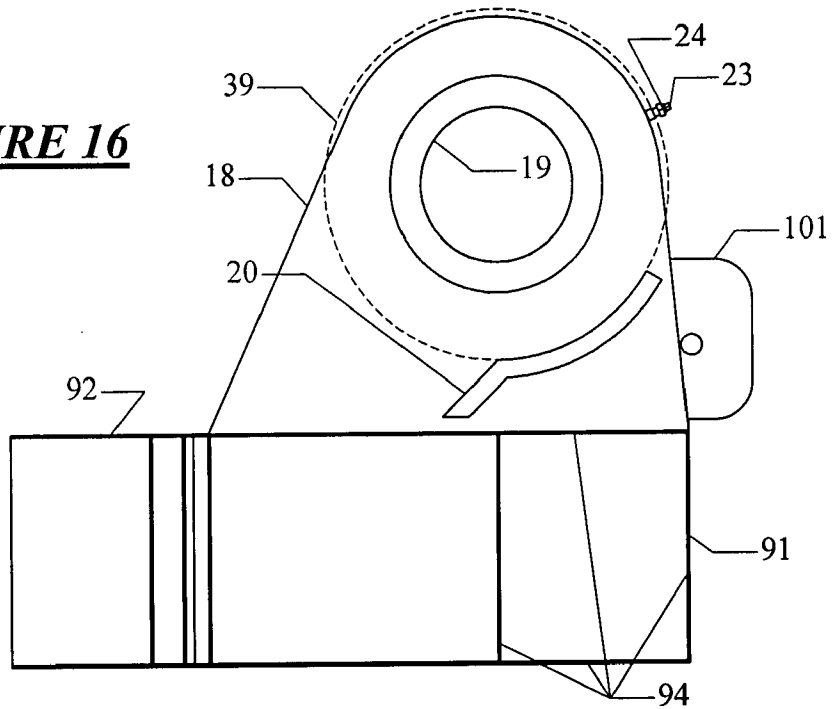
FIG. 16 shows a vertical sectional view taken along section line 16-16 of FIG. 11 and illustrates the positioning of the leg travel stops on the inner face of the pin sockets.

Each pair of the field mateable pin sockets 18 is provided with a pair of horizontal travel stops 20 on their interior facing transverse sides, as shown in FIG. 16. Each travel stop 20 is an arcuate plate concentric to the through bore 19 and welded to a vertical face of a pin socket 18 on the side of the socket adjacent a comating leg. The arcuate inner radius face of the travel stop 20 is configured to engage the outer periphery 39 of a leg end 36 so as to cause the field mateable pin assemblies 48 of that leg end to be substantially aligned with the through bores 19 of the pair of pin sockets 18 when the outer periphery 39 of that leg end abuts the travel stop. A projecting straight segment, inclined to the path of a leg end 36 as it approaches a pin socket 18 for engagement, is also provided on each travel stop 20 so that significant initial misalignments of the ends 36 of legs 26 or 43 can be corrected as the pins 48 are brought nearer to the through bores 19 of the sockets 18.

Figure 9:
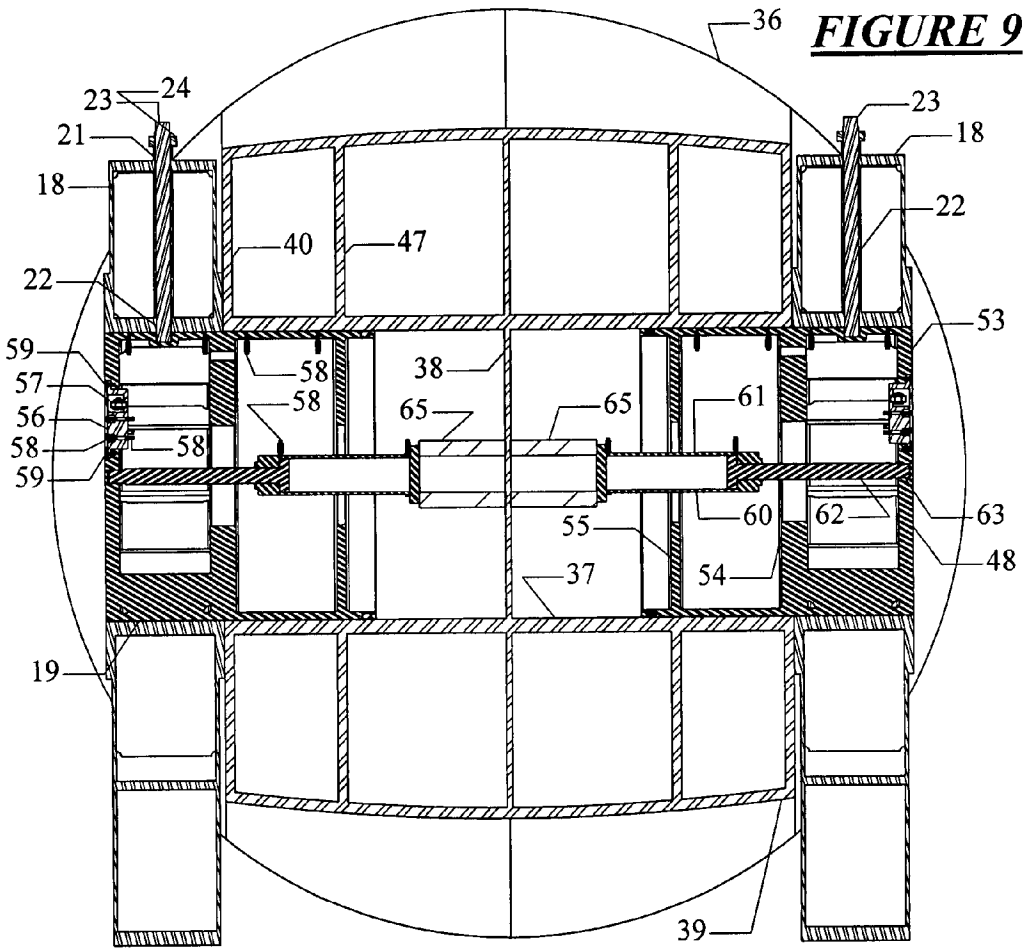
FIG. 9 is a transverse cross-sectional view of the extendable latch pins of FIG. 8 engaged with a pair of pin sockets.

Referring to FIG. 9, it can be seen that an internally threaded radially outwardly extending tubular boss 21 is welded onto the exterior of each of the sockets 18 centrally between the side plates of the sockets. The bore of the boss is coaxial with a radial penetration hole 22 extending from the interior bore 19 of the socket. An externally threaded hex headed cylindrical keeper pin 23 is threadedly engaged with the threads of the boss 21. The threads permit easy insertion and retraction of keeper pin 23 through penetration hole 22 so that locking pin pocket 51 of the field mateable pin assembly 48 can be engaged to prevent inadvertent disengagement of the pin assembly from the socket 18. Jam nut 24 mounted on the outer end of keeper pin 23 serves to lock the keeper pin in position in the boss 21.

B. The Leg System

1. The Legs

Figure 4:
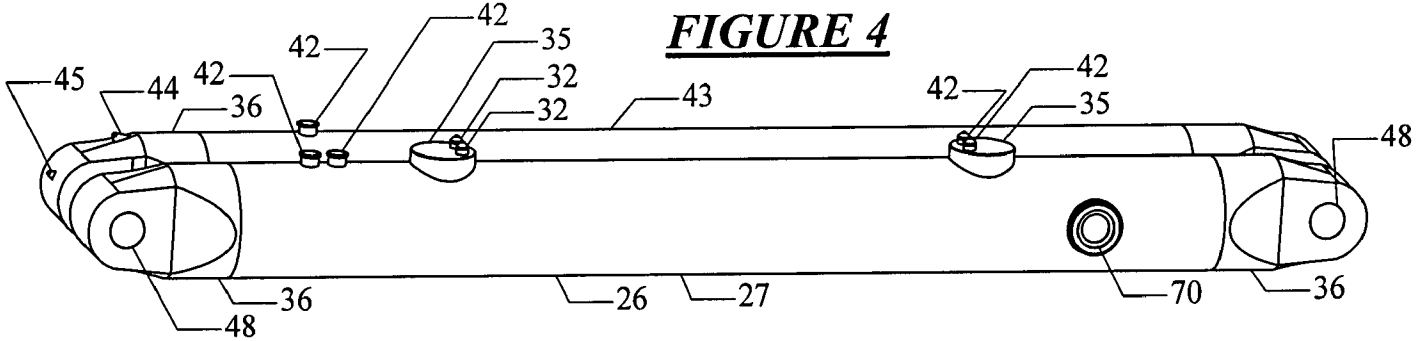
FIG. 4 is an oblique view of the leg system having a pair of parallel buoyant legs support the platform with the legs pinned together by a permanent pin serving as a main pivot pin.

A pair of the legs of leg system 25 of the present invention is illustrated in FIG. 4. The leg pair consists of a pair of the buoyant legs 26 and 43 cojoined by permanent pin 70. The legs 26 and 43 of the leg pair are structurally and geometrically substantially identical in most of their external features. Internally, any of the legs may differ, given that they provide a variety of tankage as well as buoyancy chambers and mount a variety of equipment items both internally and externally. Internal features are not shown here, since they vary substantially depending on application.

The legs 26 and 43 are of equal length and pin spacing and are constructed with essentially constant outer diameters except at their ends. Although the legs may have a variety of shapes, the preferred embodiment uses legs having a tubular construction with the central cylindrical leg body 27 having a diameter typically on the order of 25 feet to 37 feet. The pins and pin holes typically have diameters on the order of 8 feet to 14 feet, with the central permanent pin 70 being larger than the field mateable pins 48. The general leg construction of central body 27 has cylindrical tubular stiffened shell plating 28 with internal ring stiffeners and watertight bulkheads and, if required, longitudinal stringers to stiffen the skin. Generally, double walled construction of the leg is used in the region adjacent the operational waterline 123 for safety. Each leg is provided with appropriate piping (not shown) for handling the ballasting and deballasting of the leg and any fluid storage. Access passageways also are provided for inspection purposes.

Figure 7:
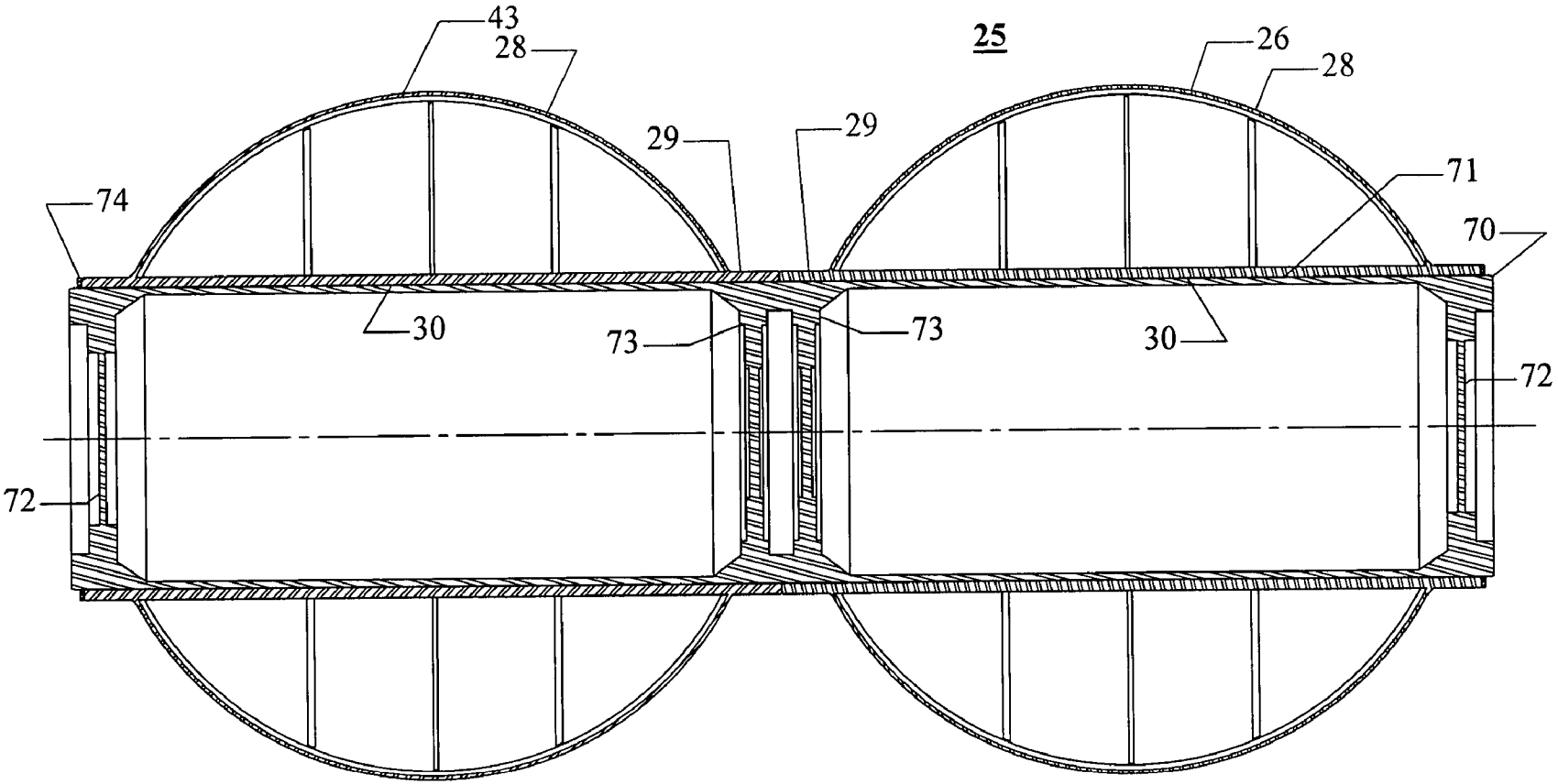
FIG. 7 is a transverse cross-sectional view taken through the main pivot pin of the pair of buoyant legs shown in FIG. 4.

The legs in a leg system 25, composed of multiple pairs of legs 26 and 43, in its operational configuration, represent the arms of an "X" with the crossing at the permanent pin and symmetry about a vertical axis. Thus, the legs 26 and 43 are inclined at opposed angles from the vertical. Each leg 26 or 43 supports intermediate to its length a transverse right circular cylindrical tube 29 interconnecting opposed sides of the central body 27 and having a uniform diameter and concentric through pin bore 30 for mounting permanent pin 70, as seen in FIG. 7 and described in more detail below. The axes of the tube 29 and the leg intersect at right angles. Thicker plates or reinforcing plates and stiffeners on the shell 28, as well as additional stiffening bulkheads, are used around the penetrations of the cross tube 29 through the side walls of the leg central body 27.

2. The Leg Bosses

The central leg body 27 of the legs 26 and 43 mounts radially outwardly extending short cylindrical bosses 31 and 34 or, alternatively, bosses 35. Bosses 31 and 34 are used only on the outer leg pairs for sets of two or more legs, while bosses 35 are used on interior leg pairs if three or more leg pairs are used on a platform. The axis of symmetry of the bosses are all in the central diametrical midplane normal to the axis of the pin bore 30 of the cross tube 29 of the leg central body 27.

The two bosses 31 and 34 or, alternatively, bosses 35 on the first tubular section of the leg central body 27 are located on the same side of the tube. All of the bosses 31, 34, 35 have the same diameter and length and are fabricated from a rolled thick plate or rolled ring short tube coped on the inner end to fit the outer surface of the first tube section of the leg body 27 and have a thick transverse disk on the outer end. The interior of the short tube is stiffened internally underneath the bosses if necessary in order to accommodate the eccentric loads applied to the tube from the cross bracing diagonal members 78 or 82 connected to the bosses. These loads will be parallel to the transverse disks on the outer end of the bosses and are transmitted from the X-brace diagonals 78 and 82 by the stabbing pins 32 mounted on the bosses.

Figures 10, 26:
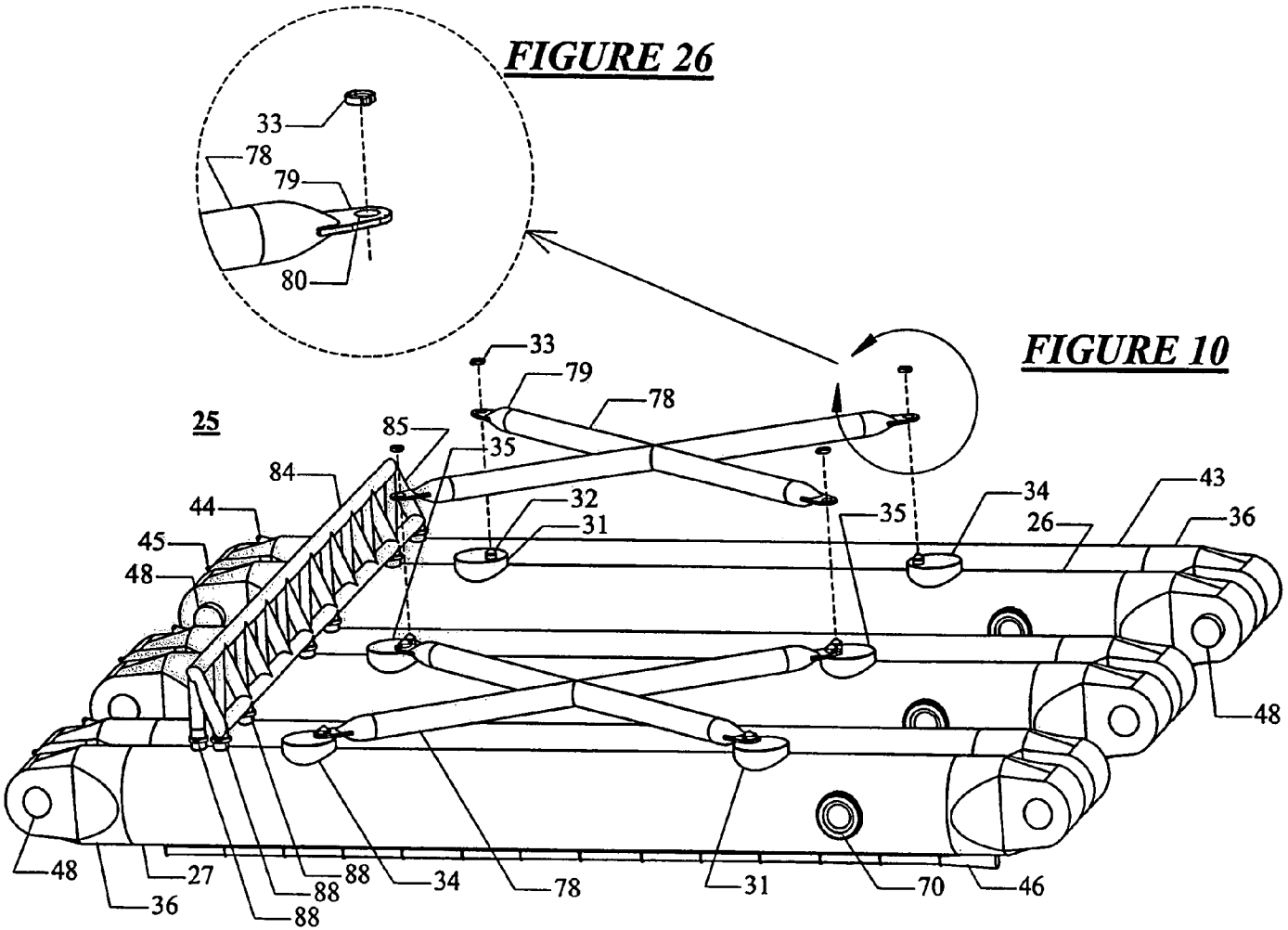
FIG. 10 shows three buoyant leg pairs, such as shown in FIG. 4, being assembled with the diagonal X-braces used to interconnect the legs.
FIG. 26 shows an enlarged detail of an end of the unconnected diagonal X-brace shown in FIG. 10.

Each boss 31, 34, 35 has one or two integrally attached short stub stabbing pins 32 located off center on the face of the boss and parallel to the axis of the boss for making connection with the end pin holes 80 in the end fittings 79 of the diagonal braces 78 or 82, as shown in FIG. 10. The number of stabbing pins on a boss corresponds to the number of connections to be made to the diagonal braces 78 or 82. The bosses 31 and 34 for outside legs in a set of multiple leg pairs have only single pins 32, while the bosses 35 for inside legs have two pins 32. Mounting bosses 31 and 34 are antisymmetrical.

Each stabbing pin 32 has a cylindrical body with a tapered nose on its outward end and an annular locking groove located in the cylindrical face outwardly from the attachment to its supporting boss. The annular groove is tightly engageable by a diametrically split retainer clamp 33 consisting of two identical semicircular short circular ring segments with outwardly projecting ears parallel to their diametrical plane of separation. Bolts or studs with nuts engaged in bolt holes in the ears permit the clamp halves to be drawn together into the groove of the stabbing pin 32 so that it will retain its connection with a closed ring end fitting 79 of a diagonal brace 78 or 82 stabbed over the stabbing pin 32. The groove is placed so that the ring end fitting 79 of the diagonal brace is held with minimum clearance in the axial direction of stabbing pin 32. The dual pin bosses 35 have their pins in the same angular location and radial position relative to the diametrical plane of the tubular legs 26 or 43 on which the bosses are located as do the single pin bosses 31 and 34.

3. Mateable Pin Leg End

Figure 8:
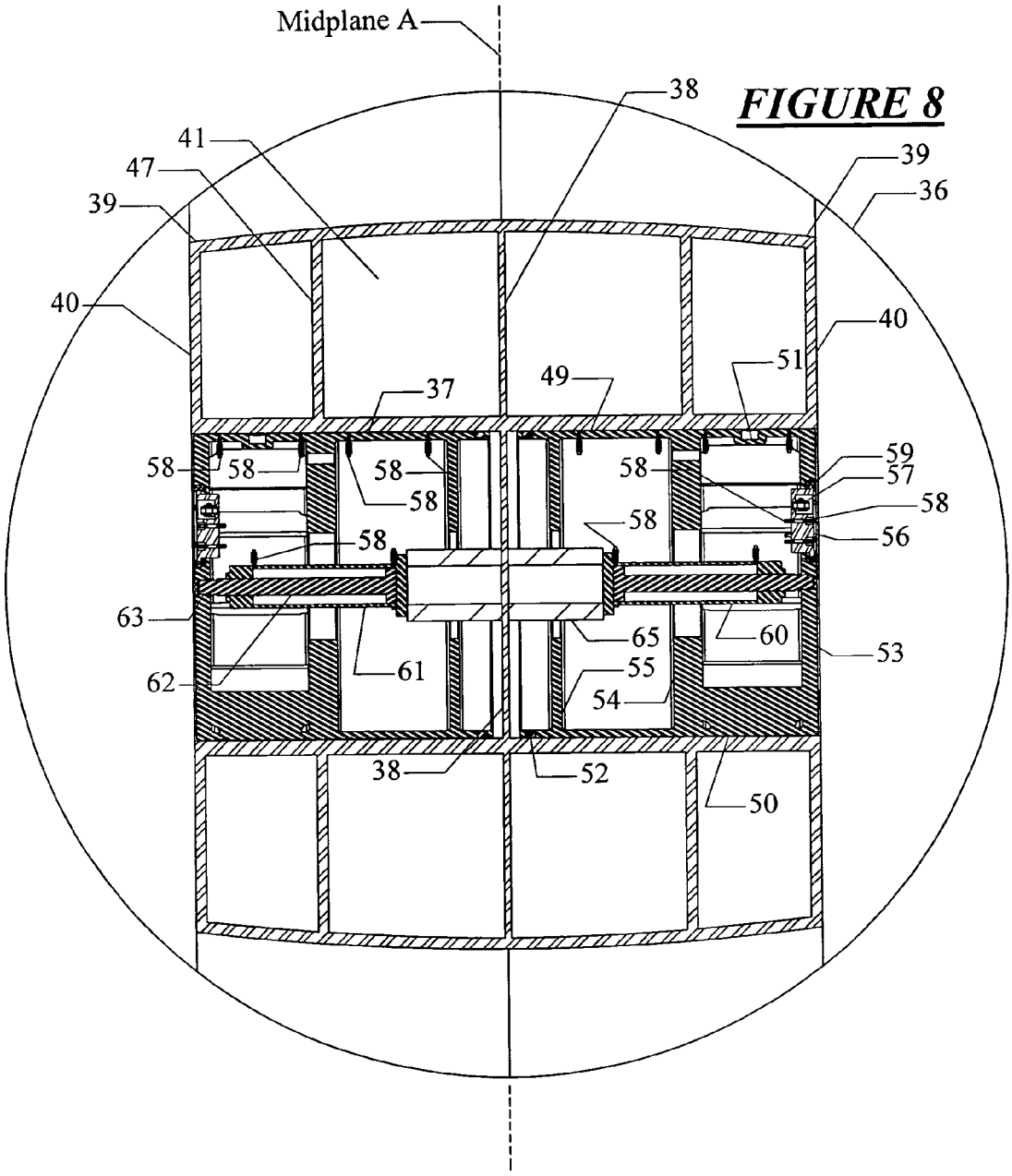
FIG. 8 is a transverse cross-sectional view of a pair of extendable latch pins in an end of a buoyant leg in their retracted position.

Each leg 26 and 43 has a field mateable pin leg end 36 at each of its distal ends. A transverse cross-section through the field mateable pin assemblies 48 mounted in a leg end 36 is shown in FIG. 8. The leg ends 36 are symmetrical about the leg midplane (midplane A) perpendicular to the permanent pin bore 30. The leg end 36 is cylindrical at its attachment point to the central leg body 27, but has symmetrically opposed flats consisting of outside plates 40 at its outer end. The flats are parallel to the midplane A of the leg and are spaced from the midplane A by a distance approximately 30-40% of the leg diameter. A constant diameter through hole intersecting the leg longitudinal axis and normal to midplane A is adjacent the outer end of the leg end 36 and penetrates from one outside plate 40 to the other. The outer end of the leg end 36 is radiused about the axis of the flat-to-flat through hole. Outer periphery 39 of leg end 36 consists of the arcuate distal portion of the radiused leg end adjacent its intersection with the flats formed by outside plates 40. This outer periphery 39 is abutted by the travel stops 20 of the field mateable pin sockets 18 when a leg end 36 is being aligned for engagement of its pin assemblies 48. A pair of symmetrical plate flats flare outwardly from the outside plates 40 of the leg ends 36 to intersect the cylindrical portion of the leg ends.

Mounted by welding in the transverse through hole of the leg end 36 is a heavy wall right circular cylindrical tube having a concentric latch pin bore 37, as shown in FIGS. 8 and 9. A longitudinally extending central diaphragm 38, positioned on midplane A of the leg end, extends through the interior of the leg end, including the interior of the transverse tube. Symmetrically spaced apart from and parallel to the central diaphragm 38 are two intermediate diaphragms 47 which extend outwardly from the outer cylindrical wall of the transverse tube to the interior of the shell wall of the leg end. One or more transverse bulkheads 41 are positioned in the interior of leg end 36 perpendicular to the midplane A. One transverse bulkhead 41 is required where the outside plates 40 intersect the flaring symmetrical flats of the leg end. Typically, a second transverse bulkhead 41 would be located close to the end of the flaring symmetrical flats near to where the leg end 36 connects to the central leg body 27. The central diaphragm 38 (particularly where it passes through the latch pin bore), the intermediate diaphragms 47, and the transverse bulkheads 41 are shown with plate construction, but may be stiffened plates or double walled shells with interior reinforcing.

The central diaphragms 38 of the leg ends are provided with multiple through bolt holes in a pattern consistent with the mounting base of the hydraulic cylinder assemblies 60 which are used to latch by extending and unlatch by retracting the field mateable pin assemblies 48. The mounting bolt holes are positioned concentric with the axis of the latch pin bore 37.

4. Field Mateable Pin Assemblies

Figure 25:
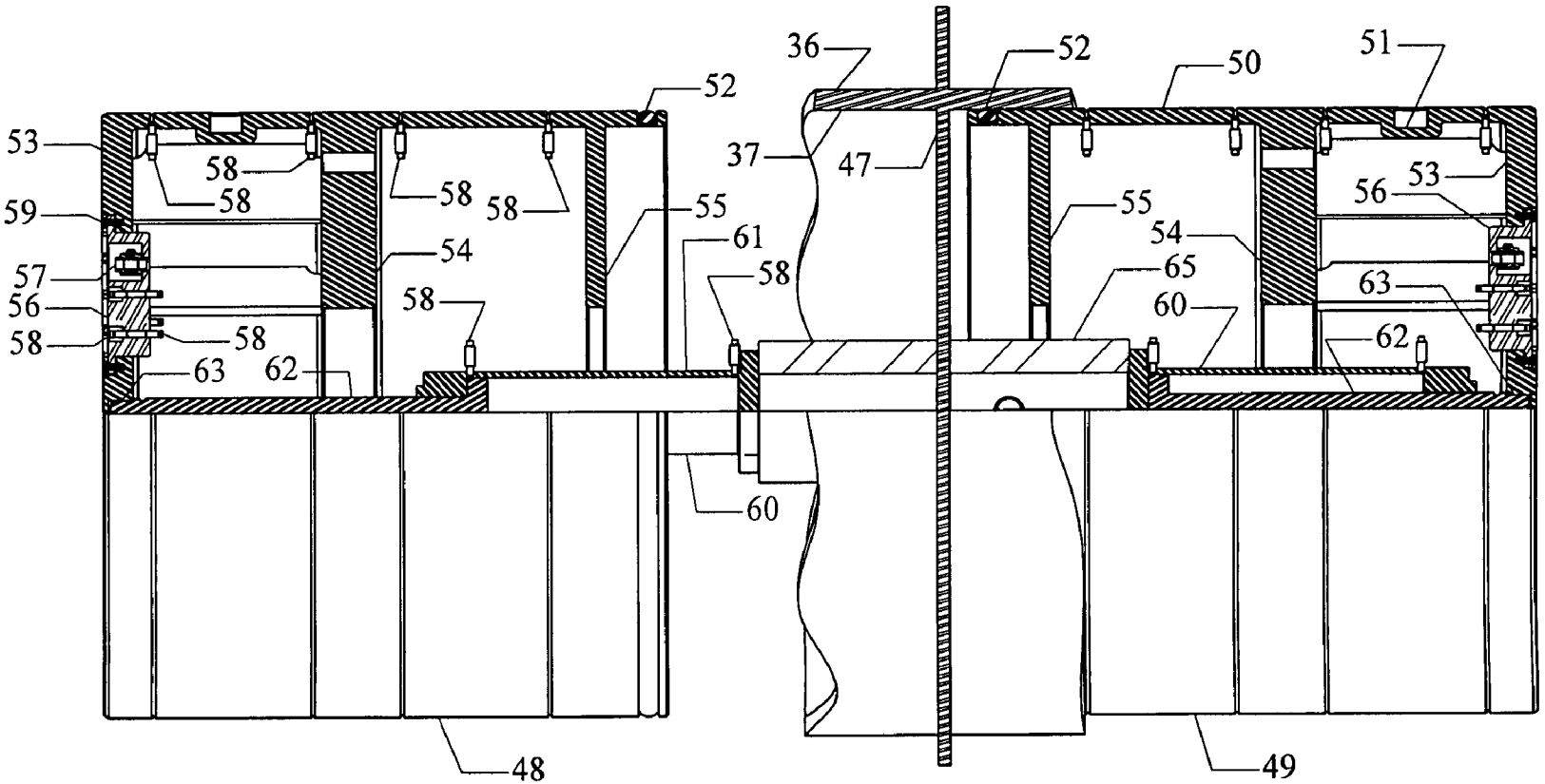
FIG. 25 shows a quarter sectional view of the field mateable pin assemblies and a portion of the supporting structure of a leg end along the pin longitudinal axes, with one pin extended and the other pin retracted.

FIGS. 8 and 9 show a longitudinal cross-section of the field mateable pin assemblies 48 in retracted and extended positions. In addition, FIG. 25 shows a longitudinal quarter-sectional view of the pin assemblies 48. Referring to those figures, two field mateable pin assemblies 48 are mounted antisymmetrically in the latch pin bore 37 of each leg end 36, with the two mounted pins straddling the central diaphragm 38 of the bore 37 of the field mateable pin leg end 36.

Each end of the field mateable pin assembly 48 consists of a pin 49, an access flange 56, a hydraulic cylinder assembly 60, and a spacer block 65, all mounted to the central diaphragm 38 by means of threaded mounting studs with nuts assembled through comating holes in the cylinder base, the spacer block 65, and the diaphragm 38. The pin 49 has a right circular cylindrical outer body 50 which is a slip fit to the bore 37 and which has an external annular O-ring groove containing O-ring 52 at its open interior end on the interior of bore 37 of the field mateable pin leg end 36. The O-ring 52 seals the annular gap between the bore 37 and the pin 49. Although it is not shown here, the pin 49 may be restrained against rotation about its longitudinal axis by means of a key and keyway or other similar means. The size of the pin 49 is such that it is a slip fit into and freely rotatable within a bore 19 of a pin socket 18.

A large bevel is provided on each external end of the external cylindrical body 50 of each pin 49, and the pins are lubricated at assembly into their mounting bores 37. The outer end of pin 49 has an integral thick transverse end diaphragm 53 and a relatively thicker integral transverse annular ring middle diaphragm 54 positioned coaxial with the cylindrical pin body 50 and spaced inwardly from the end diaphragm. End diaphragm 53 has an off-center externally counterbored hole parallel to its axis for the mounting of access flange 56. The hole for flange 56 is made large enough to serve as a manway. Drilled and tapped holes are provided on the outwardly facing transverse face between the bore and counterbore in end diaphragm 53 consistent with the bolt hole pattern in the access flange 56. Additionally, the inner side of the end diaphragm 53 has a concentric drilled and tapped hole for the attachment of the threaded rod end 63 of the hydraulic cylinder 60.

Close to the interior open end of pin 49 is located interior end diaphragm 55, which is a thinner, relatively to diaphragms 53 and 54, annular right circular ring concentrically attached to the inner wall of the cylindrical body 50 of pin 49. Intermediate between the end diaphragm 53 at the outer end of pin 49 and middle diaphragm 54 is an interior boss reinforcing the shell 50 and sealing to prevent leakage through a concentric external blind radial locking pin pocket 51 which is engageable by threaded keeper pin 23 of the field mateable pin socket 18. The cylindrical body 50 of pin 49 is provided with multiple radial through holes which are drilled and tapped on their interior ends and which intersect shallow circumferential annular grooves on the cylindrical exterior of pin 49. These grooves, shown in FIG. 25, serve as lubricant distribution channels when grease is pumped via the hydraulic quick connect fittings 58 to ease the movement of the pins into and out of engagement with the bores 19 of the pin sockets 18. The interior of the cylindrical body 50 of the pin 49 may also be reinforced with radial plates positioned between the interior transverse diaphragms 53, 54, and 55.

Access flange 56 is a thick right circular cylindrical disk with a concentric outwardly extending flange on its outside end. A bolt hole circle is provided in the periphery of the flange 56 for mounting by means of flange mounting bolts 59, and a sealing gasket (not shown) is located inwardly of the bolts so that the interior of the pins 49 is pressure-tight, as it is sealed by O-ring 52. Access flange 56 has multiple drilled and tapped through holes parallel to its axis and having outwardly opening counterbores.

A selectively operable ball valve 57 and hydraulic quick connect fittings 58 are threadedly mounted to the ends of the through holes on the outward side of flange 56 and are recessed within the counterbores. The valve 57 and the quick connect fittings 58 do not extend out past the transverse outer face of the access flange 56. The thickness of the outwardly extending flange of the access flange 56 is such that the heads of the bolts 59 do not extend outward of the outer face of the end diaphragm 53 of pin 49. Additionally, the interior ends of the through holes in flange 56 accommodating the quick connect fittings 58 are also tapped, thereby permitting the installation of two or more quick connect fittings 58 on the interior side of the flange 56.

Hydraulic hoses (not shown) are interconnected between two of the quick connect fittings 58 on the interior side of the flange 56 and to the quick connect fittings 58 on the hydraulic cylinder 60. Other hydraulic hoses (not shown) may be connected to other quick connect fittings 58 on the interior side of the flange 56 and then to additional quick connects 58 mounted in the radial drilled and tapped holes communicating with the circumferential lubrication channels of the pin 49.

Each of the hydraulic cylinders 60 is of conventional design with a cylinder body 61 having a cylinder end mounting flange. A hydraulic quick connect fitting 58 is mounted in each of the ports of the cylinder body 61. Cylinder rod 62 mounts a piston of conventional design inside the cylinder body for reciprocation in response to hydraulic pressure applied through the ports of the cylinder body. The outer male threaded end 63 of the cylinder rod 62 is threadedly connected to the drilled and tapped hole on the centerline of the interior face of the end diaphragm 53 of the pin 49. The cylinders for the two pins in each leg end 36 are mounted to tubular right circular cylindrical spacer blocks 65, which are in turn mounted to the central diaphragm 38 of the field mateable pin leg end 36 by means of mounting studs and nuts (shown in FIG. 25).

5. Permanent Leg Pivot Pins

The permanent pin 70 which serves as the pivot for a pair of legs 26 and 43 is shown in FIG. 7 in a pin centerline longitudinal sectional view as installed in the bore 30 of the central bodies 27 of the legs 26 and 43. The central leg pivot pin 70 is a right circular cylindrical tube, symmetrical about its transverse midplane, with a smooth, constant diameter outer surface 71. The pin 70 is a close slip fit to the bore 30 of the legs 26 and 43. Thick transverse end disk diaphragms 72 are provided at both ends of pin 70 where they can support and transfer shear loads between the shell plating 28 of the legs and the tubular body of the permanent pin 70.

In the central part of the pin 70, symmetrically positioned about the transverse midplane of the pin, are two transverse center diaphragms 73 in positions relative to the shell plating 28 of the legs corresponding to the end disk diaphragms 72 on the other side of the respective legs 26 and 43. The diaphragms 72 and 73 may have increasing thickness in the radial outward direction due to their having been made of multiple rings and a central disk. The center diaphragms 73 are thicker than the end diaphragms 72, since they must transfer higher shear loads. The length of the permanent pivot pin 70 is chosen so that the end diaphragms 72 and the center diaphragms 73 are located aligned with the plate sides of the central bodies 27 of the legs 26 and 43. The tube of pin 70 transfers induced pin bending loads and the diaphragms 72 and 73 transfer shear loads from the shell sides 28 of the leg central bodies 27.

A thin annular keeper ring 74 having a slip fit to the outer diameter of pin 70 is concentrically welded to the exterior of pin 70 at each end to prevent the pin from working out of the pin bore 30 of the legs 26 and 43. A small amount of axial clearance is provided between the keeper rings 74 and the transverse outer ends of the cross tubes 29 of the legs 26 or 43. While it is not shown herein, a thin annular ring bearing may be placed concentrically around pin 70 between the abutting transverse ends of cross tubes 29 of the legs 26 and 43 and also immediately inwardly of the keeper rings 74. The pin joint is lubricated on assembly.

6. Leg Diagonal Braces

The diagonal braces 78 and 82 between the legs of the floating platform 10 are best seen in FIGS. 1, 2, 3, and 10. The diagonal braces 78 and 82 are structurally identical, but are used on opposite sides of the platform. Braces 78 connect to the legs 26, while braces 82 connect to the legs 43. The legs of the diagonal braces 78 and 82 form an "X" and are inclined at equal but opposite angles with the vertical.

Both diagonal braces 78 and 82 are composed of two coplanar right circular tubular members of the same size crossing in the middle so they have three orthogonal planes of symmetry at the crossing point. The diameter of the diagonal braces is typically on the order of 5 to 8 feet. Each of the four ends of the diagonal braces is provided with an integral end fitting 79.

The end fitting 79 is circular where it is connected to the brace tubes, but is symmetrically flattened and notched in the plane of the X of the brace to accommodate a welded-in thick plate outwardly extending in the direction of the tube axis and in the plane of the brace. The plate has a rounded end with a transverse pin hole 80. The pin hole 80 has an axis normal to the plane of the brace in approximately the center of the exposed flat portion of the plate.

The transverse pin hole 80 in the center of the external plate portion of end fitting 79 is a close fit to the cylindrical body of a stabbing pin 32 on the mounting bosses 31, 34, and 35. When the diagonal brace 78 or 82 is installed over a set of parallel stabbing pins 32, as shown in FIG. 10, it serves to rigidize and properly space apart the attached legs 26 or 43 in the plane of the cojoined legs. The diagonal braces are retained on the stabbing pins 32 by split ring retainer clamps 33.

The diagonal bracing is used only above the main pins 70, since the main pins are positioned so close to the damper plate assembly 90. However, if the main pins 70 were positioned more towards the middle of the legs, then typically diagonal braces would be both above and below the pins. In such an event, it is necessary to mount the upper braces for a set of legs 26 or 43 on one side of the set of similar legs and the lower braces on the opposed side. This is so that the combined leg systems 25 can be placed in a common plane when the leg 26 is freely pivoted relative to leg 43 about the permanent pin 70 without physical interference of a lower diagonal brace with a leg 43. If upper and lower diagonal braces are to be used, the braces may have a different span in the direction of the leg axes, but the leg-to-leg spacings would be the same for both the upper and lower braces. The same types of mountings would be used as for the diagonal bracing 78 and 82 previously described.

7. The Padeyes

Two padeyes 44 and 45 are also mounted on the midplane A of the upper field mateable pin leg ends 36 of legs 43. The lifting padeye 44, positioned so that it is on the upper side of the leg 43 in FIG. 10, is constructed from thick plate with a transverse through bore for attachment of pulling lines or tackle to ease handling of the legs, particularly during the initial latching of the legs to the deck. The pull-in padeye 45, located close to the longitudinal axis of leg 43, is also constructed from thick plate with a transverse through bore for attachment of pulling lines or tackle to ease handling of the legs. Pull-in padeye 45 is particularly useful when making the final connection of the legs 43 to the deck assembly 11.

8. Pipeline Guide Tube

An optional elongated pipeline guide tube 46 with its lower end flared is mounted by transverse plate standoffs on the midplane A of one or more of the legs 26 or, alternatively, on one of more of the legs 43. Alternatively, similar guide tubes could be located parallel to the tube shown but offset from midplane A. The pipeline guide tube 46 is used for upper end support of pipelines connected to the platform 10. The tube 46 may have either its lower end or upper ends arced in order to support pipeline trajectories different than the angle of the supporting leg 26.

9. The Boat Landing and Strongback Mounts

FIG. 4 illustrates two tubular boat landing and strongback mounting hubs 42 with distal upset transverse flanges mounted on the midplane A of each leg 26 on the upper side of the leg slightly above what would be the operational waterline for the platform 10. These hubs 42 are similar in configuration to those used in Graylock™ connections. Similarly, single hubs 42 are mounted on the midplane A of each leg 43 on the upper side of the leg slightly above what would be the operational waterline for the platform 10.

10. Boat Landing and Strongback

Figure 18:
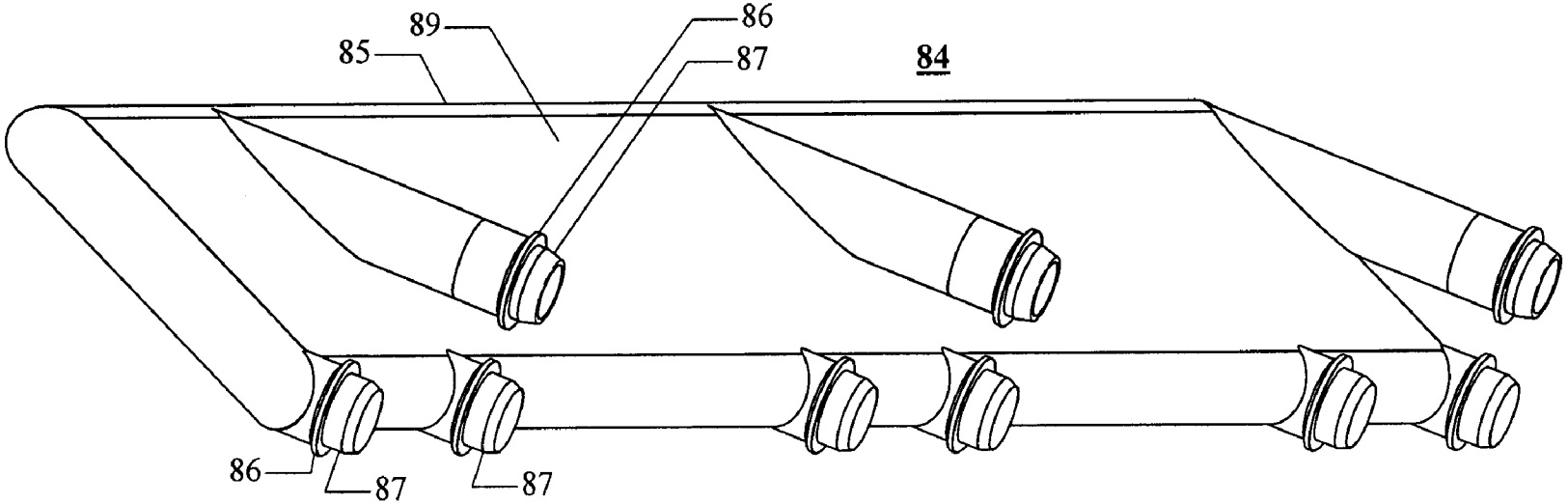
FIG. 18 shows a diagonal view of the combination boat landing and strongback with stabbing noses.

The combination boat landing and strongback 84, shown in more detail in FIGS. 10 and 18, is a tubular planar Pratt truss 85 which is attached at structural nodal points to all three of the fixed hinge pin legs 26 on their upper sides as shown in FIGS. 1, 2 and 10. The strongback function of truss 85 is only required for structural integrity before the platform 10 is fully assembled. When the platform is fully assembled, the boat landing function is more critical, although the strength contribution of the truss 85 is not undesirable. Two attachments located on the midplane A are used for each leg 26. Optionally, in the plane of the truss 85, an additional mounting hub 86 and supporting nodal point in truss 85 can be provided for a more rigid connection of the combination boat landing and strongback 84 to each of the legs 26. This arrangement would require an additional mounting hub 42 on each leg 26, with adjustment of the positions of the mounting hubs 42 coplanar with the truss 85 so that they symmetrically straddle the midplane A of the leg.

The depth of the truss is approximately 12 to 20 feet. The boat landing and strongback 84 is attached to the legs 26 slightly above the operating draft water level of the platform. This location permits the use of the strongback truss 85 as a practical boat landing. The plane of the truss is inclined relative to the leg axes so that it will be level when the platform is completely erected. The upper side surface of the truss is provided with perforated decking to provide a walking surface and the outer horizontal chord and horizontal transverse ends of the truss can be provided with fendering (not shown) to prevent damage during collisions with boats. Tubular diagonal knee braces connect between the outer chord of the truss and the adjacent leg 26 at the nodal points aligned with the legs in order to strengthen and rigidize the truss for vertical loadings. Although not shown in the drawings, stairs from the deck 11 can be attached to one or more of the legs 26 supporting the combination boat landing and strongback 84, and the stairs interconnected to the boat landing deck by means of access ramps.

The combination boat landing and strongback 84 is provided with mechanical connections so that it can be selectably removed or attached to the platform 10, even on location in the field. This feature permits removal of the boat landing and strongback 84 in the field for repairs, or for field installation of a boat fender to the legs 43 so that the structure has boat fenders on both sides. Additionally, the use of the mechanical connections instead of welding to attach the combination boat landing and strongback permits the temporary installation and later removal of a strongback 84 for use during transportation and erection of the structure.

As shown in FIGS. 1 and 18, the mechanical connection for the combination boat fender and strongback 84 is made by means of comateable tubular upset hubs 86 and 42 provided on the connecting ends of the truss 85 and on the legs of the platform 10, respectively. The hubs 86 on the strongback 84 are substantially identical in construction to the hubs 42 provided on the legs 26 of the platform 10. Clamping of the comating connector hubs 86 and 42 is accomplished by means of split clamping hubs 88 similar to the design used in Graylock™ connectors or the retainer clamps 33 used for mounting the diagonal braces 78 and 82.

As shown in FIG. 18, the mounting hubs 86 of the boat landing are provided with integral tubular stabbing nose 87 inserts mounted in their interiors and extending outwardly. The stabbing noses 87 have a conical bevel at their distal ends to promote entry into the bore of comating mounting hubs 42 on the legs 26 during mounting of the boat fender 84. The stabbing noses 87 not only cause the strongback 84 to align with its mounts 42, but they also transfer transverse shear loadings during assembly.

C. The Damper Plate Assembly

1. The Damper Plate

The term damper plate as used herein means an optional structure for connecting the lower ends of the leg pairs. The damper plate may be any size or configuration and may be composed of a number of components. In fact, the permanent pin 70, or similar structure interlocking the legs, can serve as a damper plate particularly if positioned at the outer ends of the leg pairs.

Figure 6:
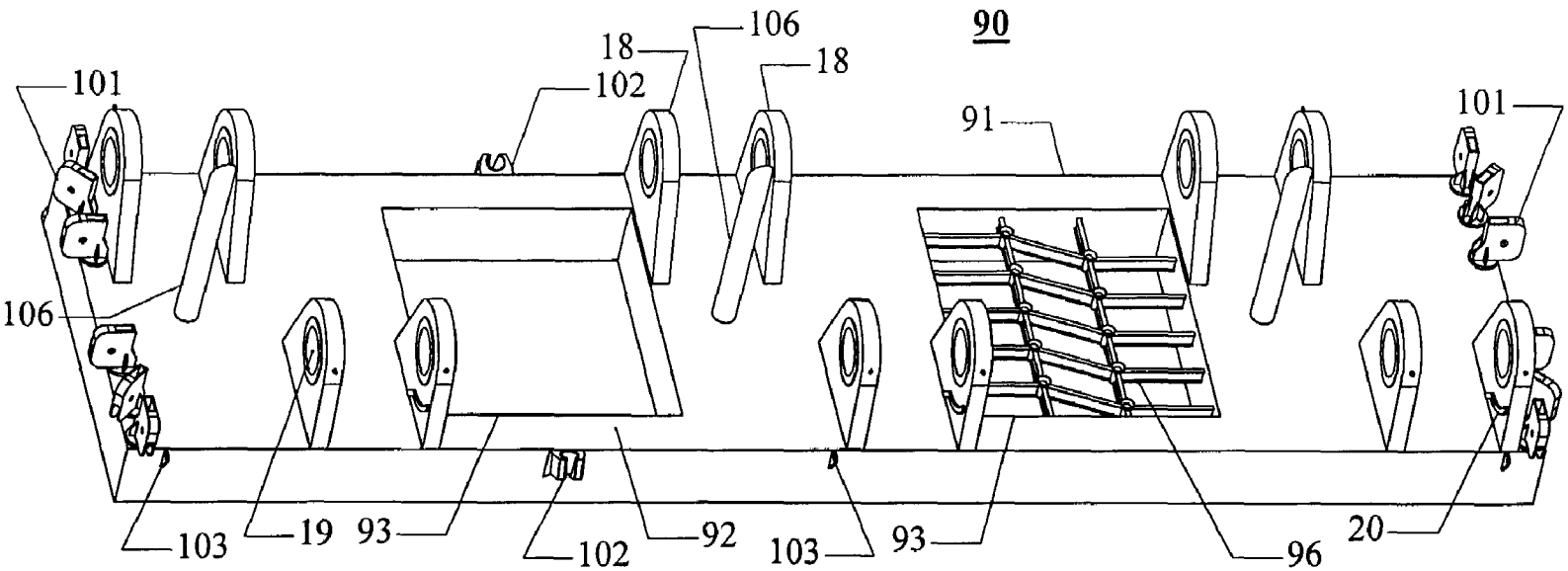
FIG. 6 is an oblique view of the upper surface of the damper plate structure, in which the field mateable pin sockets are shown.
Figure 11:
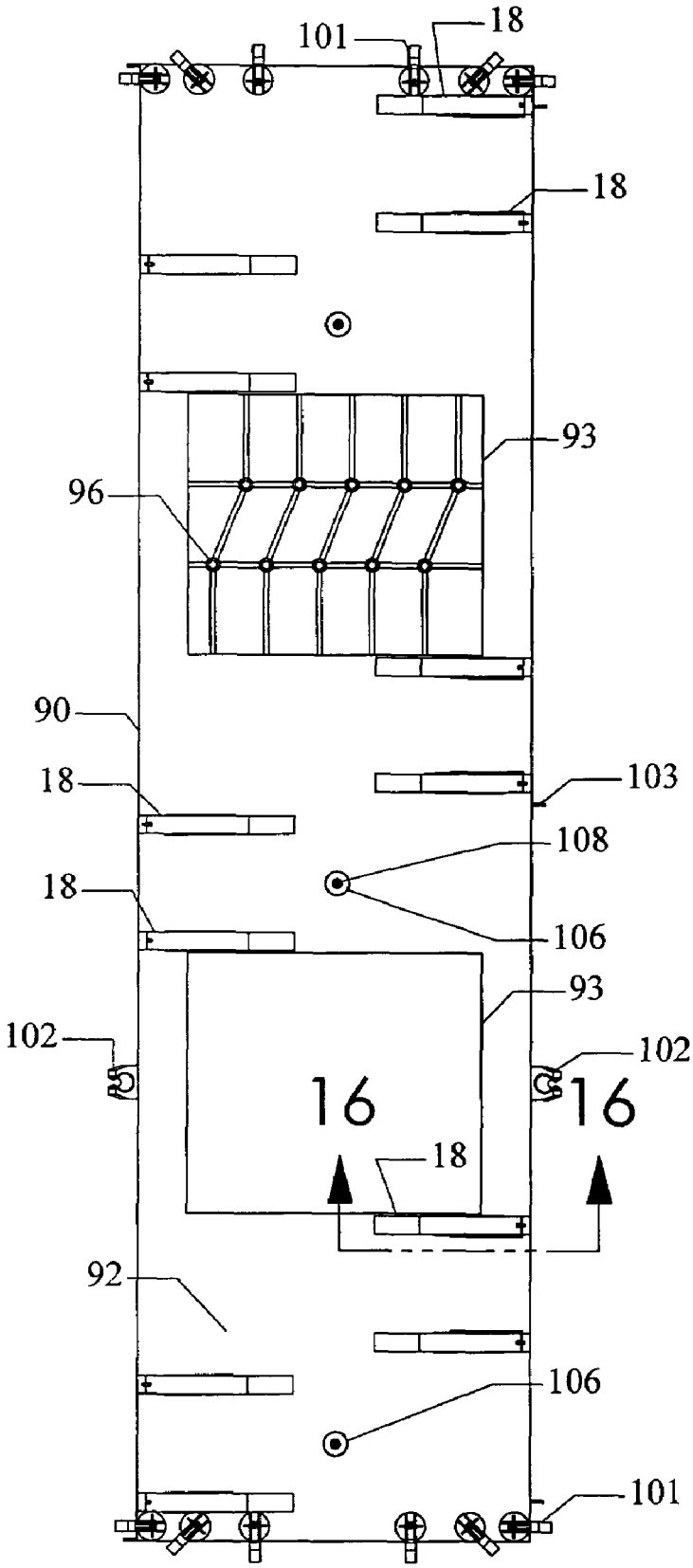
FIG. 11 is a plan view of the upper side of the damper plate structure.

A preferred embodiment of the damper plate assembly 90 is shown in FIGS. 6 and 11. The damper plate 91 of the damper plate assembly 90 is a symmetrical rectangular prismatic barge-like structure composed of stiffened rectangular plates with two rectangular intermediate bays symmetrically and centrally located in the structure. One of the intermediate bays 93 is positioned underneath the well bay 12 of the erected deck 11. The upper surface of damper plate 91 is covered with horizontal deck plating 92 in order to provide reactive surface area for damping action in wave motion.

The damper plate 91 is provided with internal stiffening as it has to transmit fairly large structural loadings both to and between the field mateable pin sockets 18 mounted on its upper surface. On the periphery of each long side of the damper plate, the external and internal stiffened plate structure creates a longitudinal tube 94 substructure illustrated in the cross-sectional view of the damper in FIG. 16. Likewise, the transverse stiffened plate box structures adjacent the intermediate bays 93 and normal to the longitudinal tube structures 94 constitute tubular cross members. These torsionally rigid structures create a strong and rigid mounting for the pin sockets 18. Additionally, for use with a production deck such as is shown for the first embodiment 10 of the present invention, a conductor guide tray 96 similar to the conductor guide tray 13 on the deck structure 11 is provided in the intermediate bay 93 underneath the well bay 12 of the deck. The damper plate structure 91 is flooded when the platform 10 is installed. The damper plate 91 can be made freely flooding or alternatively it can be sealed and provided with selectably controlled valves (not shown) for permitting ingress and egress of air and water for providing temporary buoyancy during preassembly. The damper is always flooded when the platform 10 is installed.

2. Mooring Fairleaders

Multiple swiveling mooring fairleaders 101 are mounted on the upper deck plating 92 adjacent each corner of the damper plate 91. The mooring lines (not shown) run downward vertically from winches or chain jacks mounted on or in the deck structure 11 to the fairleaders 101 and then out to the anchors for the platform 10 when it is in its final installation position. The moorings lines can be wire rope, chain, synthetic rope or any combinations of these materials.

3. Pipeline Anchor Receptacle and Padeyes

A pipeline anchor receptacle 102 for catenary pipelines is mounted on each side of the damper plate 91 in a central location in a gap between adjacent leg pairs as an alternative to using only the pipeline guide tube 46 for pipeline support. The receptacles 102 have a converging downward tapering bore and an access notch on their outward side. The axis of the bores is inclined from the vertical to be consistent with the anticipated angle of departure of a pipeline suspended therefrom.

In addition, three support padeyes 103 are positioned in line with the centerlines of the second legs 43. The padeyes 103 provide lifting points for positioning the damper plate assembly 90, if required.

4. Mateable Pin Sockets

Mounted on the upper side of the horizontal plating 92 of the damper plate 91 on opposed edges are a series of multiple equispaced pairs of parallel field mateable pin sockets 18. As is the case for the deck structure 11, the field mateable pin sockets 18 are of identical buttress construction, having horizontal axis bores 19 as well as side reinforcement plates around the bores. All of the bores 19 of the sockets 18 on each long side of the damper plate 91 are coaxial. A preferred embodiment, shown in the drawings, has three pairs of pin sockets 18 on each side of the damper plate 91 to accommodate three sets of legs 26 and 43.

5. Tubular Knee Braces

Figure 13:
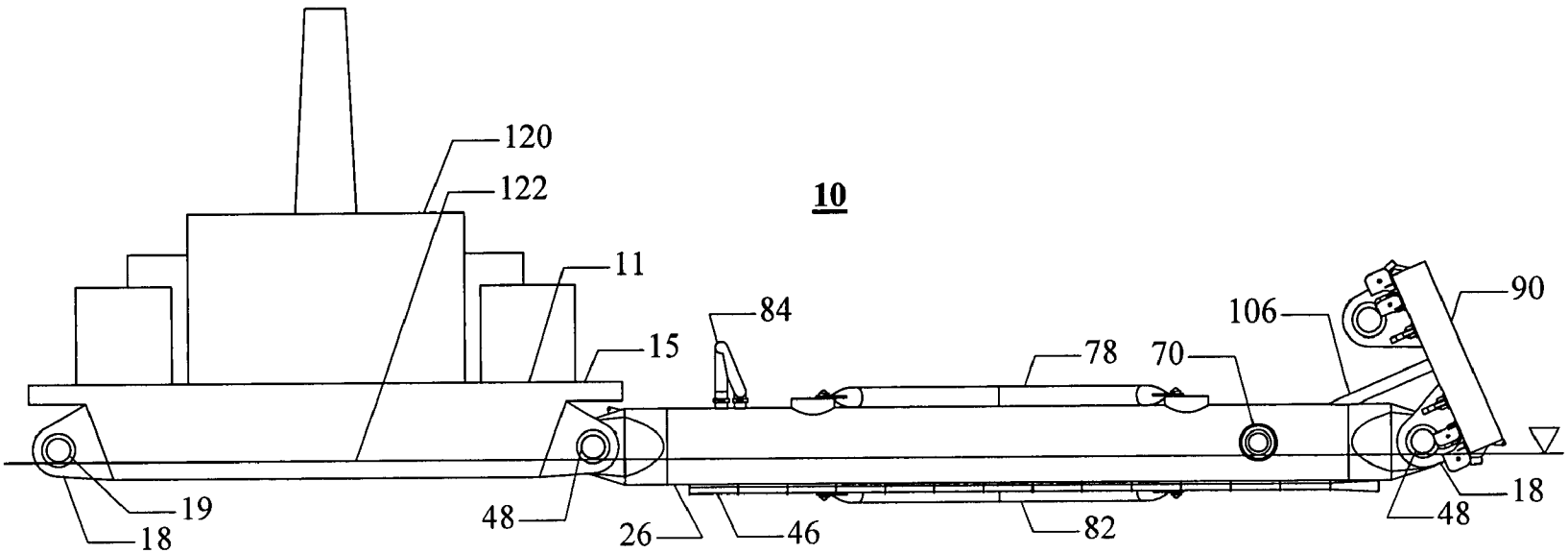
FIG. 13 shows the second mating in which the pin sockets on the first side of the deck are mated with the pins at the end opposed to the damper plate end of the first legs of the leg pairs of the cojoined legs.
Figure 17:
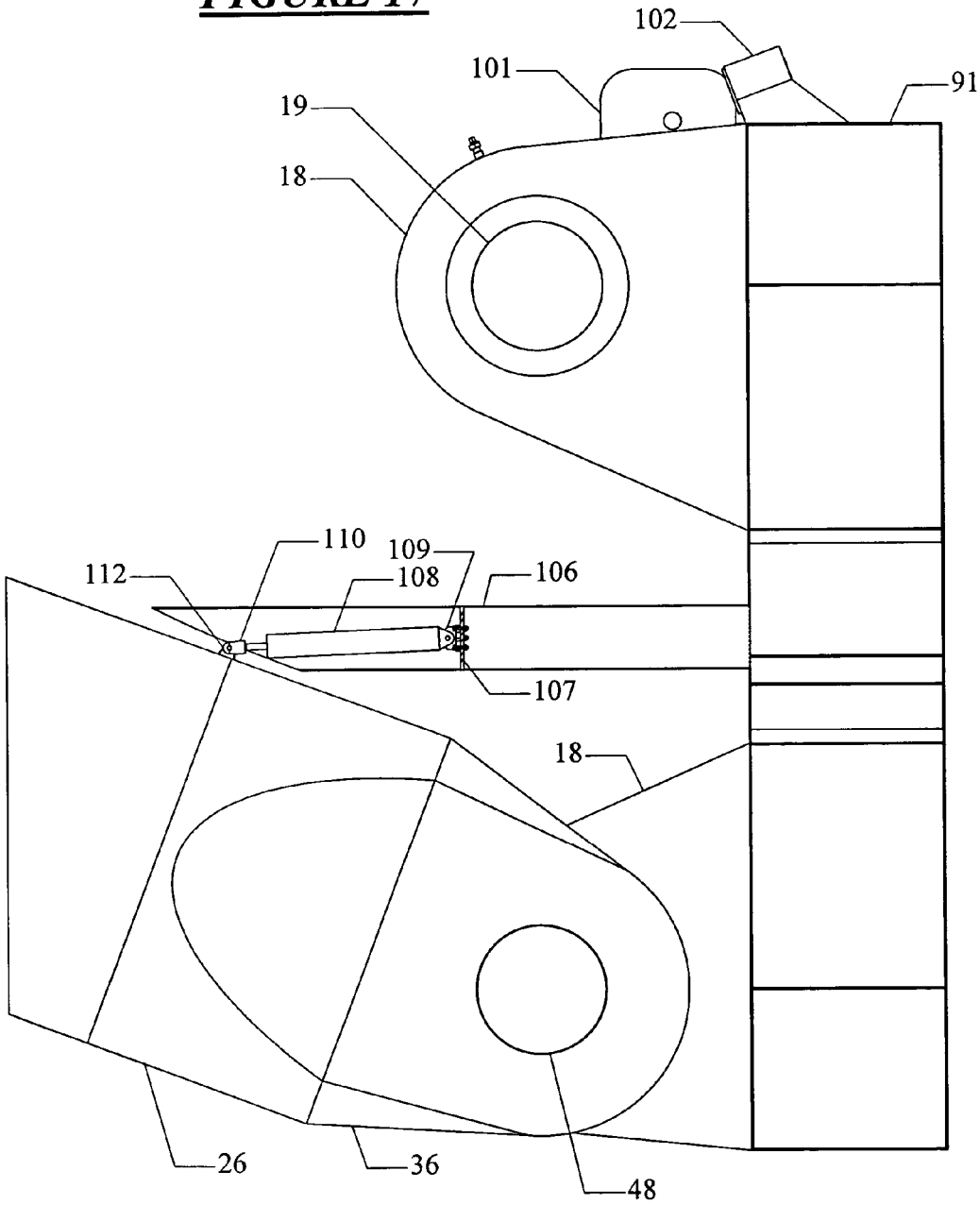
FIG. 17 is a vertical sectional view taken along the axis of a knee brace when the legs of the platform are joined to the damper plate structure as shown in FIG. 12.

One or more tubular knee braces 106 are employed to provide adequate support for the damper plate assembly 90 when the partially assembled floating platform is being transported, as is shown in FIG. 13. Additional support bracing for the knee braces 106 may be required, but is not shown here for simplicity of description. The knee braces 106 are mounted perpendicular to and along the longitudinal center plane on the upper deck plating 92 of the damper plate 91. The knee braces are each positioned on the midplane A of a mated first leg 26. The distal ends of the knee braces are coped to conformably mate with the abutting outer surface of the legs 26 when the damper plate assembly 90 is rotated sufficiently to cause the knee braces to contact the legs. As shown in FIG. 17, interior to the knee brace 106 is an integral plate transverse internal diaphragm 107 on which is mounted a hydraulic bias cylinder 108 with a clevis mount 109. The outer end of the cylinder rod has a transverse pin fitting which is engaged with a leg-mounted plate padeye that serves as a leg clevis 110. Supplementarily, the padeyes 103 can be used to attach releasable cables (not shown) to the legs 26 for the restraint of the damper plate assembly 90 while the leg system 25 is being transported or being rotated.

D. Alternative Platforms

1. First Platform Embodiment

The assembly procedures for the first platform embodiment 10 of the present invention described above are illustrated in FIGS. 13 to 15. The first platform embodiment 10 is shown with a production deck payload 120 on the deck 11. The deck 11 can readily support either a drilling payload, a production payload, or a combined payload without external modifications to its hull and pin sockets 18. The representation of the production deck payload 120 shows a workover rig, quarters modules, and process equipment modules, with all the payload items mounted externally on the deck upper surface. Various arrangements of these components can be made without departing from the spirit of the invention. In order to better illustrate the attitude and draft of the platform 10 during its final assembly operations, the water surface 122 is used to indicate the position of the surface relative to the platform. Water surface 123 is shown in FIG. 15 to indicate the operating condition water level for the completely assembled platform 10 after it has been elevated by deballasting.

2. Second Platform Embodiment

Figure 19:
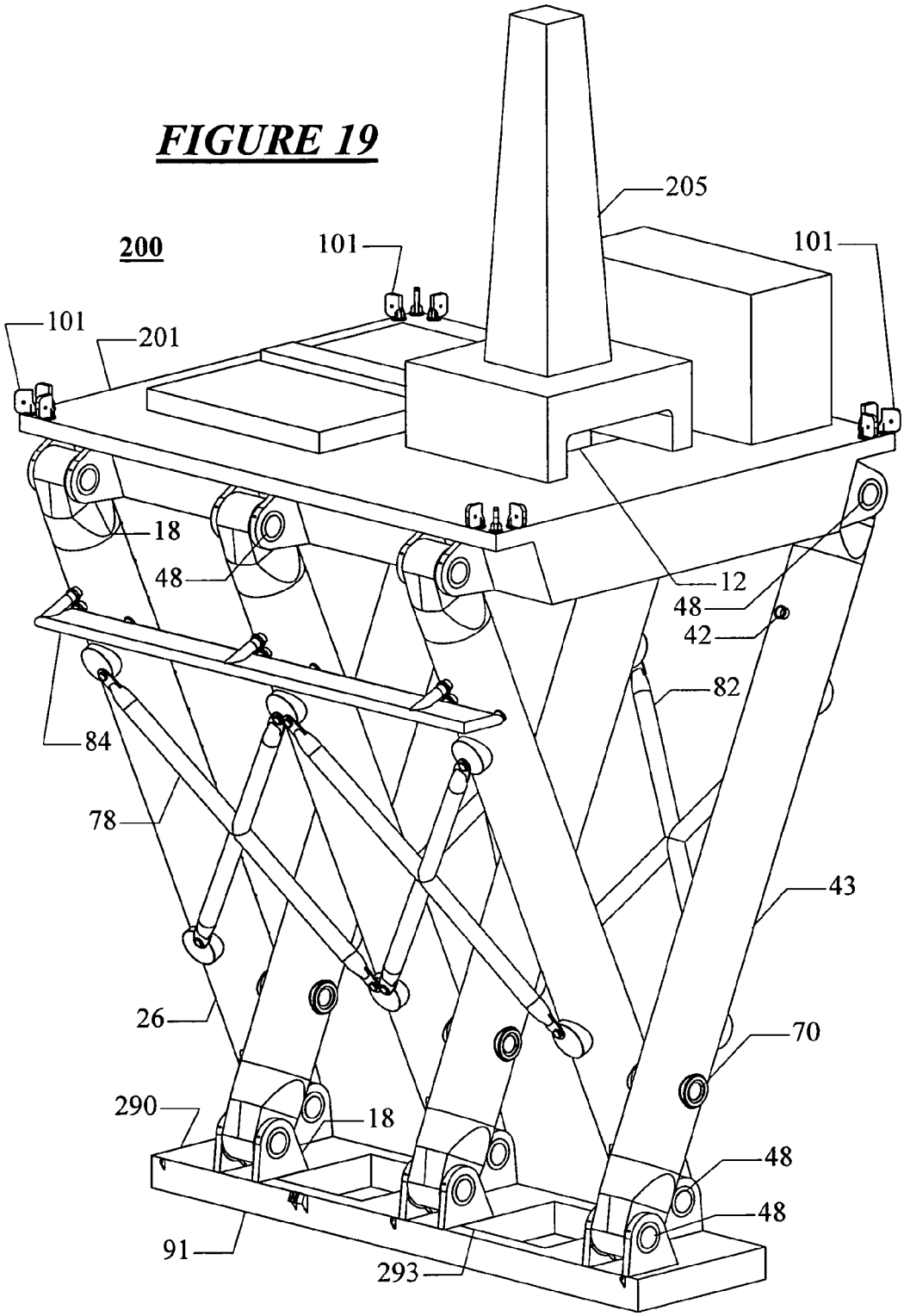
FIG. 19 shows an oblique view of a second embodiment of the inclined leg floating platform with the mooring fairleaders mounted on the deck structure.

A second platform embodiment 200 is shown in FIG. 19. Structurally, platform 200 is identical to the first platform 10 with the following exceptions. Deck structure 201 supports mooring fairleaders 101 at each corner, so that the mooring lines (not shown) extend directly to the anchors from the deck level, rather than from the damper plate assembly.

Additionally, platform 200 is shown with a pictorial representation of a drilling equipment arrangement 205 on the upper surface of its deck structure 201. Since the deck 201 is used for drilling, the conductor guide tray 13 is omitted as well. Further, since the mooring fairleaders 101 mounted on the deck 201 are used with this embodiment, no fairleaders are shown at the corners of the damper plate assembly 290 and the conductor guide tray 96 is eliminated.

This embodiment 200 of the platform of the present invention offers a different response to the action of waves, currents, and wind acting on the platform than would be the case for the first embodiment 10. In some situations, this platform 200 may offer better motions and responses to operational marine conditions than the first platform 10. Additionally, the handling of the moorings for the platform 200 is generally simpler than for platform 10, but at the expense of a reduction in useable deck area.

3. Third Platform Embodiment

The third platform embodiment 300, shown in FIGS. 20 to 23, is arranged so that its mooring fairleaders are mounted on its legs at an intermediate position between the deck 11 and the damper plate assembly 90. Other than changes relating to the mounting of the fairleaders 101 for the mooring system, platform 300 does not differ in its details from platform 10.

This particular mooring arrangement offers potential relative improvements in platform heeling and motion response in response to wind, wave, and currents. The mounting of the fairleaders at an intermediate level, rather than at the top or bottom of the platform, does add some structural complexity.

Figure 20:
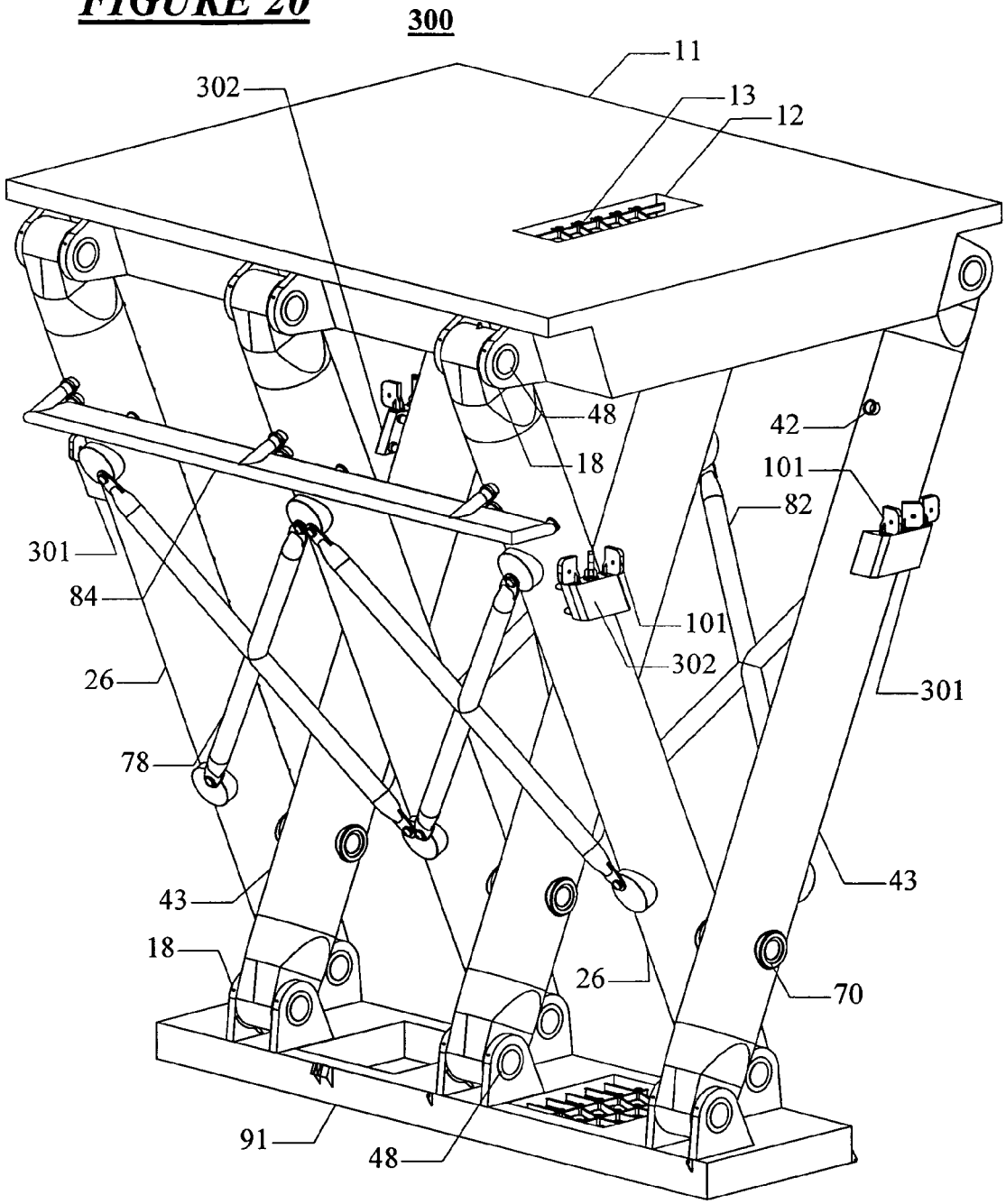
FIG. 20 is an axial view of an outer leg pair of a third embodiment of the inclined leg floating platform with mooring fairleaders mounted at intermediate positions along the length of the legs.

FIG. 20 is an oblique view of the platform 300 showing the mooring fairleaders 101 mounted on a permanent fairleader support 301 for two diagonally opposed platform corner legs and on a removable fairleader support 302 for the other two diagonally opposed platform corner legs. The corner leg 26 on the lefthand side of FIG. 20 mounts a permanent fairleader support 301 and the righthand side corner leg 43 mounts another permanent fairleader support 301, such that the fairleader supports are diagonally opposite on the farthest positioned legs from the platform center. Similarly, the legs mounting the removable fairleader supports 302 are diagonally opposed on the other corner legs of the platform. The removable fairleader supports 302 are also positioned on one first leg 26 on the righthand side and one second leg 43 on the lefthand side of FIG. 20. The legs mounting the removable fairleader supports are the inboard legs of the leg pairs at the ends of the platform 300.

Figure 21:
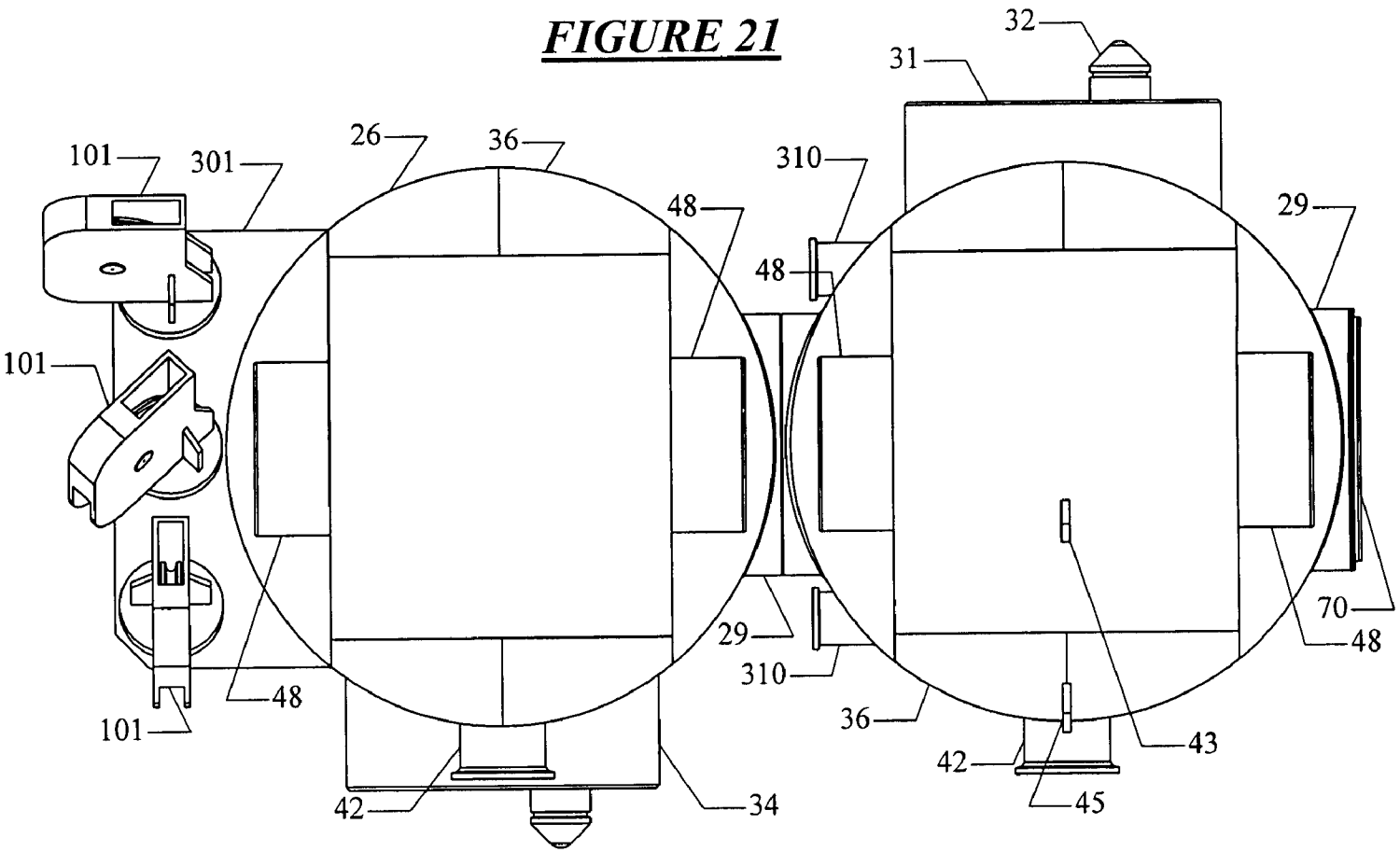
FIG. 21 is a cross sectional view of a pair of legs showing a permanent fairleader support structure welded to one leg and the removable fairleader support structure missing from the other leg.
Figure 22:
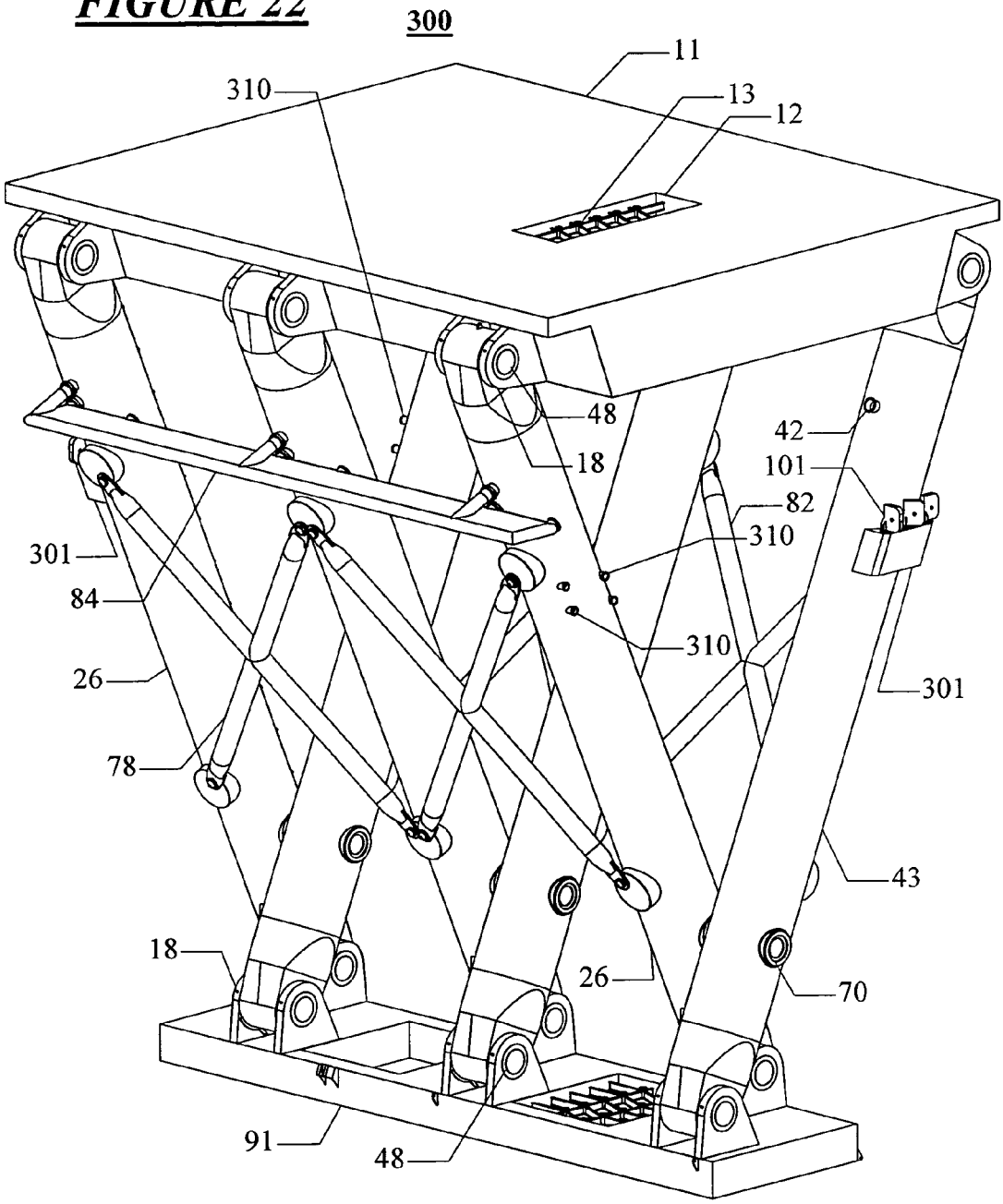
FIG. 22 is an oblique view of the third embodiment of the floating platform with the structure erected completely except for the attachment of the removable mooring fairleader support structures.

The reason for utilizing removable fairleader supports 302 for interior corner leg-mounted fairleaders can be seen in FIG. 21, which shows looking axially from their upper ends a leg pair comprised of a first leg 26 and a second leg 43 which are in their parallel position, such as is shown in FIGS. 4 and 10. This leg pair is on the left hand side of the platform 300 as seen in FIGS. 20 and 22. Potential physical interference between this lefthand first leg 26 and a permanent fairleader support 301 mounted on the righthand second leg 43 requires use of a removable fairleader support 302.

In FIG. 20, multiple horizontal tubular fairleader support mounting hubs 310 project towards leg 26 from the side of leg 43 adjacent the other leg in the pair and parallel to the axis of pin 70. Each hub 310 is welded to its mounting leg and has an outwardly extending distal transverse flange. The hubs 310 are similar in structure and support to the combination boat landing and strongback mounting hubs 42. The amount of axial projection of the hubs 310 is such that they do not extend past the transverse end of the cross tube 29 for their supporting leg and so do not interfere with adjacent leg 26 during leg rotation. For the outside leg pair at the other end of the platform 300, the hubs 310 are similarly mounted, but are supported on a first leg 26, as can be seen in FIG. 22 on the righthand side. FIG. 22 shows a view of the platform 300 fully erected, corresponding to FIG. 20, but with the removable fairleader supports 302 not present at either end of the platform.

The two permanent fairleader supports 301, as seen in FIGS. 20, 21, and 22, are identical prismatic plate fabrications with parallelogram profiles on their vertical faces, with their outer vertical faces parallel to the midplane A of their supporting leg. When the legs to which the supports 301 are attached are in their fully installed positions, the upper and lower surfaces of the supports are horizontal, while the transverse sides are inclined parallel to the leg axis. The rear faces of the supports 301 are coped to conform to the profile of the legs to which the supports 301 are mounted by welding, while the intersections of the outer vertical and inclined faces are chamfered. Multiple fairleaders 101 are mounted on the upper horizontal surfaces of the permanent fairleader supports 301. Although not shown here, the mooring lines for both types of fairleader supports 301 and 302 extend vertically from mooring winches mounted on or inside the deck 11 to the fairleaders 101 and thence outwardly to anchors in a conventional spread mooring pattern.

Figure 23:
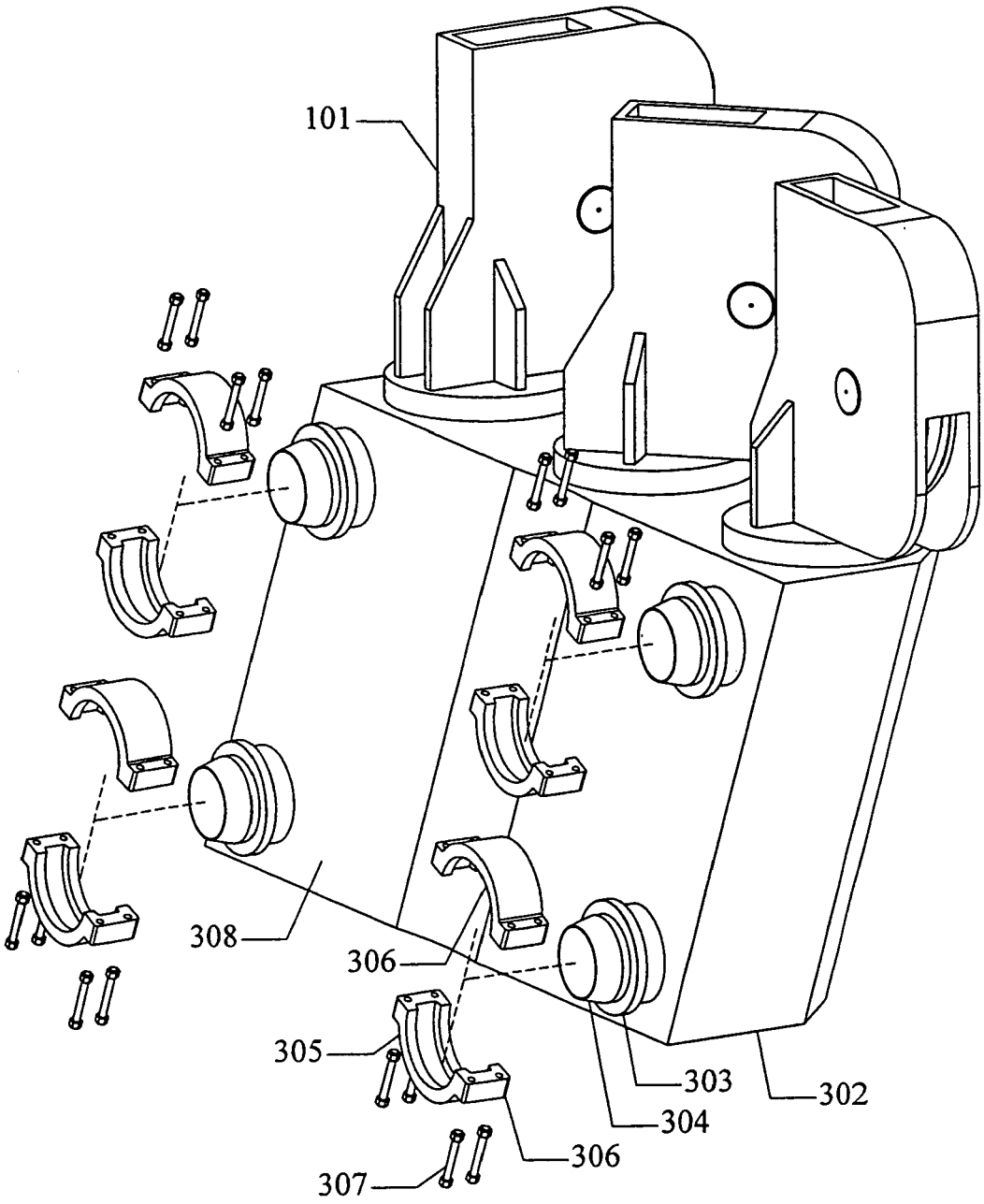
FIG. 23 is an oblique view of a removable fairleader support structure.

FIG. 23 shows the mounting or reverse side of the removable fairleader support 302. The removable fairleader supports are identical prismatic plate fabrications with parallelogram profiles on their vertical faces, with their outer vertical faces parallel to the midplane A of their supporting leg. The parallelograms of the removable supports 302 are antisymmetric to those of the permanent supports 301. When the legs to which the supports 302 are attached are in their fully installed positions, the upper and lower surfaces of the supports are horizontal, while the transverse sides are inclined parallel to the leg axis. The rear faces 308 of the removable supports 302 are generally flat, parallel to their outer vertical faces and, hence, vertical. As shown in FIG. 23, the rear faces are slightly coped centrally to conform to the profile of the legs to which the supports 302 are mounted, thereby reducing the standoff of the support 302 from its mounting leg. The intersections of the outer vertical and inclined faces are chamfered. Multiple fairleaders 101 are mounted on the upper horizontal surfaces of the removable fairleader supports 302. Projecting horizontally and normal to the rear face 308 of each removable support 302 near its corners are multiple attachment hubs 303 which are coaxial, engageable, and comating with the corresponding fairleader support mounting hubs 310 extending from the leg which will provide mounting for the support. Each attachment hub 303 is tubular with an externally upset transverse flange and a concentric stabbing nose 304 mounted in its bore. The stabbing noses 304 of the hubs 303 are a close slip fit to the bore of the mounting hubs 310. When each of the stabbing noses 304 are fully engaged in their mounting hubs 310, the fairleader support latching clamps 305 are used to rigidly mount the removable fairleader support 302 to its supporting leg. The support latching clamp 305 is similar to the split clamps 33 and 88 previously described for the first platform embodiment 10. Clamp 305 consists of two identical clamp halves 306 held together around the flanges of the hubs 303 and 310 by multiple stud and nut sets 307.

4. Second Deck Embodiment

Figure 24:
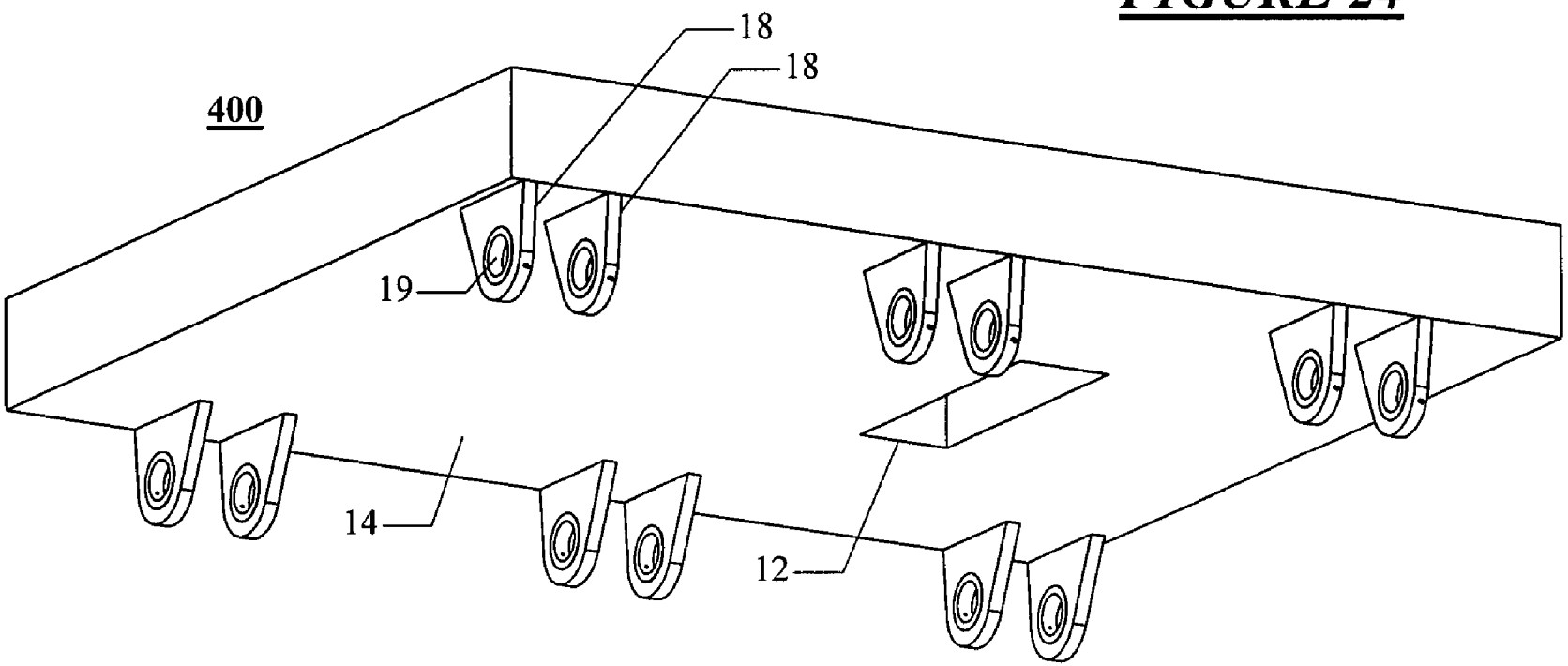
FIG. 24 shows an alternative arrangement of the deck structure with the field mateable pin sockets under the deck bottom plating.

A second deck embodiment 400, shown in FIG. 24, is basically similar to the deck structures 11 and 201 used for the previously described platform embodiments 10, 200, and 400. Like those decks, deck 400 can be configured for drilling, production, or a combination of the two activities. The deck 400 similarly has a well bay 12 and, if used for production purposes, a conductor guide tray 13. However, the deck 400 is a right rectangular prismatic barge which has its pin sockets 18 mounted on the underside of the deck bottom plating 14 so that the pin sockets project vertically downwardly. The deck 400 is directly interchangeable with deck 11 and, if provided with fairleaders 101, also with deck 201. The fabrication and installation procedures for deck 400 will differ from those for either decks 11 or 201, given the greater height and floating draft of deck 400.

OPERATION OF THE INVENTION

The operation of the inclined leg floating production platform 10 of the present invention is largely concerned with the assembly of the structural system from its component subassemblies. The simplest embodiment of the invention has a buoyant deck with at least two cojoined leg pairs attached at one end. The final assembly is performed in deep water where the leg pairs are rotated under the deck and attached at the opposite side of the deck to stabilize the structure.

The preferred embodiment has three main subassemblies: the deck structure 11, the cojoined buoyant legs 25, and the damper plate assembly 90. Two types of pins connect these main subassemblies: the field mateable pin assemblies 48 and the permanent hinge pins 70. Alternatively, cross bracing the legs with the first diagonal braces 78, the second diagonal braces 82, and the combination boat landing and strongback 84 are preassembled on the platform 10. Once the platform is preassembled as shown in FIG. 13, it can be towed to a deep water location at or enroute to its final installation site for its final assembly, shown in FIGS. 14 and 15.

Standard shipyard, steel fabrication, and machining techniques are available for the manufacture of each of the structural components. The manufacturing of the components is well known to those skilled in the art and is not discussed herein. The deck structure can have its entire facilities payload preinstalled before the transportation of the preassembled platform 10 from the yard where the components are mated, as shown in FIG. 13 where a production deck payload 120 is shown mounted on the deck 11.

A critical operation in the preassembly of a preferred embodiment of the legs 26 and 43 is the insertion of the field mateable pin assemblies 48 into the bores 37 of the field mateable pin leg end 36. This is done by preassembling the hydraulic cylinder assemblies 60 to the interior drilled and tapped holes on the centerlines of the end diaphragms 53 of the pins 49 and then aligning the cylindrical bodies 50 of the pins 49 with the bores 37 of the field mateable pin leg end 36 of the leg 26 or 43. After the pins 49 are well into the bore 37, the hydraulic cylinder assembly 60 and the spacer block 65 for each pin are attached to the central diaphragm 38 of the field mateable pin leg end 36. Access to the interior of the pins 49 is available through the access holes in their end diaphragms 53.

Another operation in the yard preassembly of the platform 10 is the joining of a first leg 26 with the second leg 43 by means of insertion of a permanent pin 70. This operation is done for all pairs of the legs. The assembly is begun by setting the two legs 26 and 43 parallel to each other with the pin bores 30 of the cross tubes 29 of their central bodies 27 coaxially oriented. The positioning is done by any suitable means (cranes, rubber tired rollers, skidding, and the like), such as are commonly used for large fabrications.

At this point, a leg pivot pin 70 is coaxially aligned with the bores 30 and urged through first one bore and then the next until pin 70 has its transverse ends extending slightly beyond the outer faces of the cross tubes 29 of the central bodies 27 of the two legs 26 and 43. The pin 70 is dimensioned so that it has a running or sliding fit in the bores 30, as defined by ANSI (the American National Standards Institute), so that it can be urged into position by means of large hydraulic cylinders or any other appropriate type of jack (not shown).

The keeper rings 74 are mounted coaxially on the pin 70 with small axial end clearances between the rings 74 and the cross tubes 29 and attached by welding to the pin 70. The keeper rings serve to retain the leg pair 26 and 43 together. The length of the pin 70 is such that the end 72 and center diaphragms 73 are substantially centered under the side shell plating of the cojoined legs 26 and 43, thereby strengthening and stiffening the permanent pin connection. Thus, the heavy shears in the permanent pin connection are transferred directly through the rigid diaphragms.

Another yard operation involves attaching the diagonal braces 78 and 82 to the leg system 25. Before the diagonal braces 78 and 82 are attached to the leg system 25, the horizontal pairs of legs 26 and 43 must be parallel and properly spaced apart with their central permanent pins 70 and mateable pin assemblies 48 respectively coaxial. The leg pairs are then joined together by the first diagonal braces 78 and the second diagonal braces 82, as shown in FIG. 10. The attachment of the diagonal braces to the leg pairs requires that the leg system 25 be elevated for the diagonal braces 82 to be mounted on the underside of the legs. Note that this operation could be done with the legs afloat.

The second diagonal braces 82 are then lifted by jacking or a crane or, if afloat, buoyancy, until the pin holes 80 of the end fittings 79 are able to stab over the stabbing pins 32 on the mounting bosses 31, 34, and 35. When the flats of the end fittings 79 are flush against the transverse faces of the mounting bosses, the split retainer clamps 33 can be engaged with the annular grooves of the stabbing pins 32 to clamp and retain the diagonal braces on the legs. The mounting of the first (upper) diagonal braces 78 is accomplished in the same general manner, with the manipulation of the diagonal braces being done by crane.

Following completion of this portion of the preassembly, the combination boat landing and strongback 84 is typically attached to interconnect each corresponding first leg 26 of each of the three leg pairs. When the platform 10 is fully assembled, it is structurally stable without the presence of the combination boat landing and strongback 84, but the strongback 84 is particularly helpful in towing the partially assembled platform offshore. In most situations, the limited water depth adjacent the waterfront facilities of the yard handling the preassembly of the platform 10 and large draft of legs with a dependent strongback 84 necessitates the positioning of a combination boat landing and strongback 84 only on the upper side of the cojoined leg pairs 25, as is shown in FIGS. 10 and 12.

The stabbing noses 87 of the strongback 84 are engaged into the bores of the two mounting hubs 42 attached to each of the legs 26 and the single hubs 42 attached to each of the legs 43, and the comating mounting hubs 86 and 42 are then abutted. The split latching clamps 88 are installed to rigidly affix the boat landing and strongback to the platform legs. Note that the mounting hubs 42 are positioned so that the combination boat landing and strongback 84 will be level and slightly above the operational high water level 123 of FIG. 15 when the platform is fully deployed. The addition of one or more strongbacks 84 to the cojoined legs appreciably stiffens and strengthens the leg assembly so that those legs remain substantially coplanar. It should be noted that, in this condition, the leg assemblage could be towed safely at sea from one location to another, if weather and sea conditions are not excessive. Additional temporary bracing can be added in order to enhance structural integrity during towing.

Figure 12:
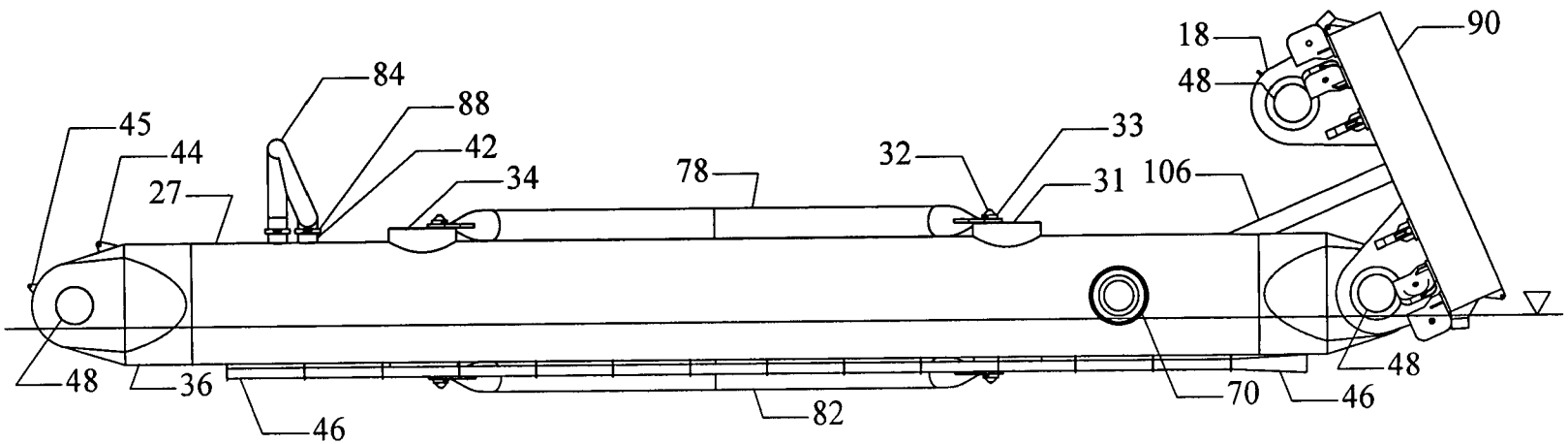
FIG. 12 is a side profile view showing the initial mating of the damper plate assembly with the set of multiple leg pairs shown in FIG. 10, wherein the pin sockets on the first side of the damper plate are connected to the first legs of the multiple leg pairs.

Another preassembly operation, typically done at the yard, is the joining of the damper plate assembly 90 to the leg system 25 to achieve the configuration shown in FIG. 12. This preassembly can be done with the leg system 25 on land or in the water. The description given here is for the case when the legs are afloat and their lower (when installed) ends are brought adjacent to the waterfront bulkhead in the assembly yard. One or more derricks or large cranes (not shown) are necessary in order to hold and orient the damper plate assembly 90 so that it extends out over the edge of the bulkhead and its lower side is at an elevation to mate with the leg ends.

Adjusting of the ballast in the leg system 25 can permit close prealignment of the bores 19 of the lower pin sockets 18 on the damper plate 91 with the field mateable pin assemblies 48 in the leg ends 36 at the lower end of the first legs 26. Additionally, the travel stops 20 on the interior side of the pin sockets 18 aid in achieving alignment. With the pins and sockets aligned, the pins 48 can be pressed into the bores 19 by using the cylinders 60 of the pin assemblies. The ball valves 57 on the access flanges 56 of the field mateable pin assemblies 48 are opened only when extending or retracting the pins to avoid creation of a pressure differential due to pin movement that could prevent full pin travel. Preestablished hydraulic connections between one or more hydraulic power sources and the quick connect fittings 58 on the access flanges 56 of the pins 48 are used to operate the cylinders 60. Further, grease can be injected into the grease supply quick connects 58 of the access flange 56 to further aid the insertion of the pins 48. While the pin sockets 18 are provided with threaded keeper pins 23, the keeper pins for this pin connection are not inserted until both sets of pin connections for the damper plate assembly 90 have been made.

After the pins 48 are engaged in the pin sockets 18 on the damper plate assembly 90, the pins on the rod ends of the bias cylinders 108 of the knee braces 106 are made up to the leg devises 110 mounted on the side of the legs 26. Refer to FIG. 17. This attachment can be aided by extending the cylinder so that it is easier to access the leg clevis and rod pin. Following this connection, the damper plate assembly 90 can be gradually lowered using the derricks and/or cranes and the cylinders 108 for control. When the coped ends of the knee braces 106 abut the cylindrical surface of the legs, then the cylinders 108 are isolated so that the damper plate is maintained in a stable position. If desired, cables (not shown) attached at one end to the lower end of the legs can be used to further stabilize the position of the damper plate by restraining the upper edge of the damper plate. FIG. 12 shows the finished position of the damper relative to the legs following the completion of this preassembly step.

Another preassembly operation involves attaching the deck structure to the platform 10. Refer to FIG. 13. In order to avoid heavy lifting and moving, this preassembly operation requires that both the deck structure 11 and the fully cojoined leg system 25 with the attached damper plate 91 be launched as shown for the legs in FIG. 12. This operation can be done in relatively shallow water next to the waterfront bulkhead of the fabrication yard. The deck end of the cojoined leg pairs is ballasted so that the submerged leg ends 36 of the first legs 26 can be inserted into the gaps between the pairs of field mateable pin sockets 18 of the deck structure 11 by relatively adjusting the spacing between the legs and the deck structure. Proper relative positioning is necessary so that the bores 19 of the sockets 18 and the bores 37 and field mateable pin assemblies 48 of the first legs 26 are coaxial. This alignment can be aided by the use of the travel stops 20 of the pin sockets 18 against which the periphery 39 of the leg ends may be pulled or pushed and/or urged by ballast adjustment. At that point, the pins 48 can be pressed into the bores 19 by using the cylinders 60 of the pin assemblies. Hydraulic connections can be preestablished between one or more hydraulic power sources and the quick connect fittings 58 on the access flanges 56 of the pins 48. Further, grease can be injected into the grease supply quick connects 58 of the access flange 56 to further aid the insertion of the pins 48. While the pin sockets 18 are provided with threaded keeper pins 23, the keeper pins for this pin connection are not inserted until the platform 10 is in its final configuration.

The final step for a preassembly operation involves the deballasting of the legs so that they are at their desired towing draft and trim. Reference to FIGS. 8 and 9 shows how the rigid transverse plate diaphragms 53, 54, and 55 of the field mateable pins 48 are centered under the transverse side plates 40 and intermediate bulkheads 47 of the leg ends 36 and the side plates of the pin sockets 18. This positioning strengthens and stiffens the completed pin connections by permitting efficient shear and moment and reaction transfer for the combined structure. Thus, the large forces in the pin connections are transferred directly through the rigid diaphragms in both the leg ends 36 and the pins 48.

With the completion of the preassembly of the platform components, the elements of the platform 10 are all interconnected for transportation. The preassembled platform, while fairly strongly connected, is still not rigid, given that the deck assembly 11 and the damper plate assembly 90 are pivotably connected to the leg system 25. However, the platform preassembly is seaworthy and able to be towed offshore, providing that sea conditions are not excessive. Marine weather forecasting is generally sufficiently accurate that the platform can be moved safely to a deep water location for final assembly without excessive risk.

The final assembly of platform 10 occurs in deeper water. Thus, the platform 10 is towed to a deeper water location where there is sufficient clearance between the seabed and the deployed legs and damper plate for the completion of the final steps of assembly. When the weather and the waves are sufficiently calm, the final assembly operations are performed.

For towing purposes, the provision of temporary welded or mechanically connected ties between the legs 26 and the other platform elements may be advisable in order to ensure that excessive relative motion is avoided, but these are not shown here and are probably not necessary for towing of the platform to most locations. These temporary ties would be released prior to proceeding with the assembly. The combination boat landing and strongback 84 compels the leg system 25 to remain coplanar until the boat landing latching clamps 88 are removed from the connections of the boat landing and strongback 84 to the second legs 43.

The starting position for these operations corresponds to FIG. 13. At the deepwater assembly location, the platform 10 is held in position by tug boats and prepared for latching the field mateable pin assemblies 48 at the lower (in service) end of the second legs 43 to the pin sockets 18 at the upper side of the damper plate assembly 90. In order to accomplish this, any temporary sea fastenings used during the tow out between the legs and the damper plate are removed. Hydraulic fluid is then applied to the bias cylinders 108 of the knee braces 106 so that the damper plate assembly 90 is caused to rotate sufficiently towards vertical that rotation of the second legs 43 relative to the first legs 26 can take place without interference.

Figure 14:
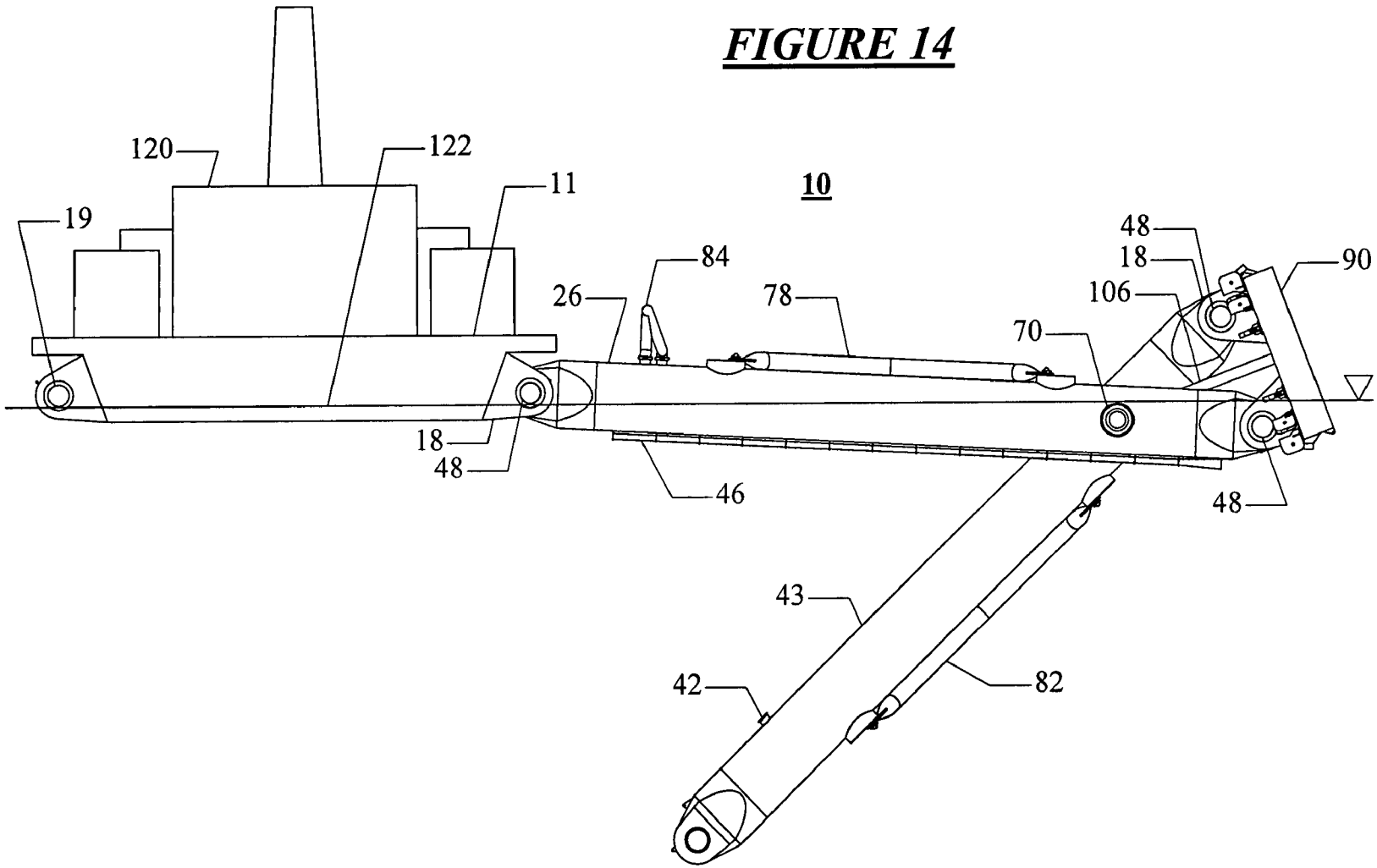
FIG. 14 shows the partially assembled platform of FIG. 13 in deep water undergoing the third mating operation where the first legs of each leg pair is attached both to the damper plate and the deck structure and maintained on or near the surface, while the second legs of each leg pair are ballasted to rotate about the pivot pins such that the second legs are latched by their operable pins to the pin sockets on the second side of the damper plate.
Figure 15:
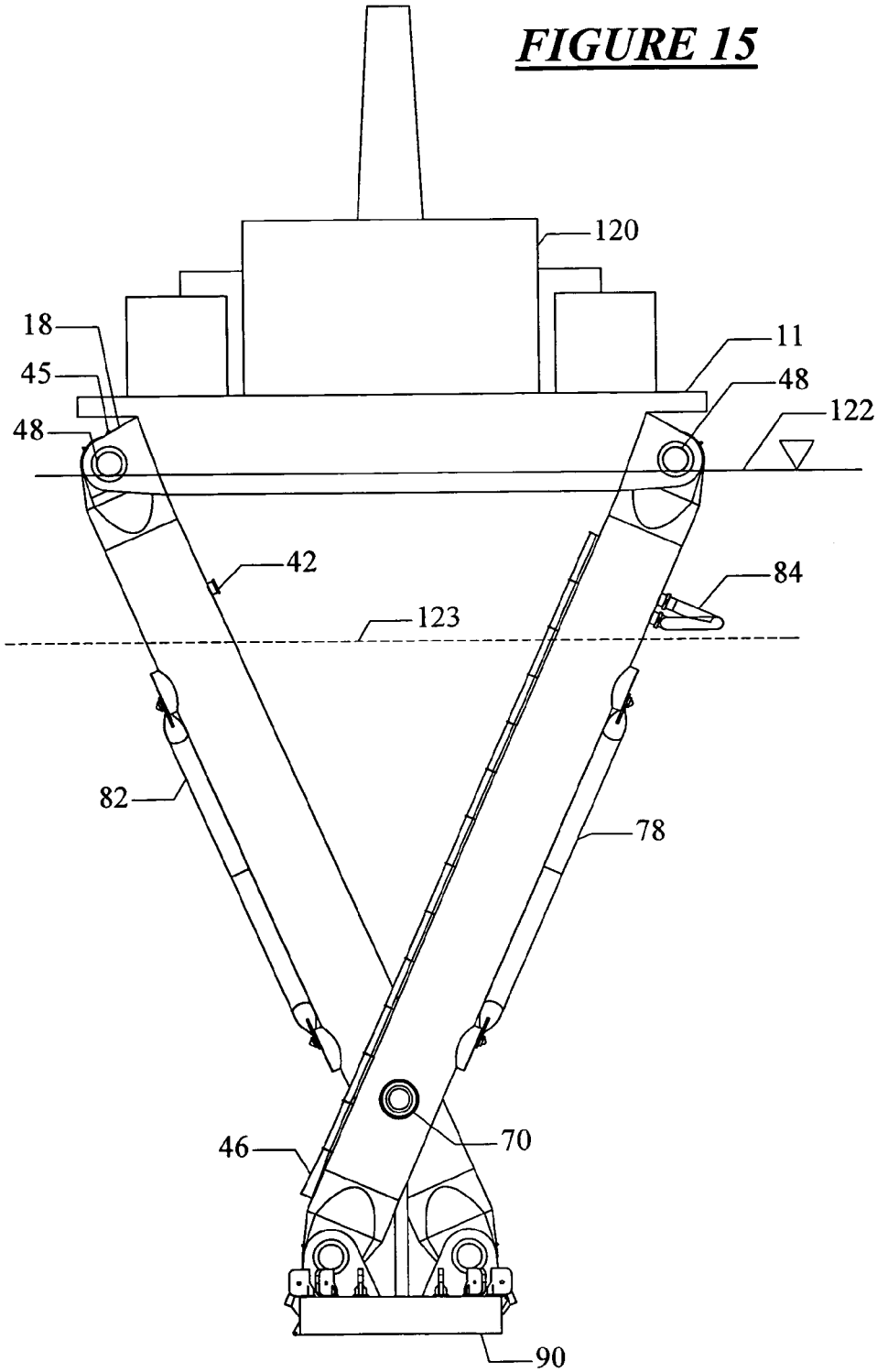
FIG. 15 shows the platform of FIGS. 13 and 14 after the legs have been sequentially ballasted to rotate as a unit with the cojoined damper plate about their connection to the deck structure sufficiently to permit the making of the fourth and final operable pin connection between the second legs of the multiple leg pairs and the pin sockets at the second side of the deck section, whereupon the legs are deballasted to raise the platform to its operating draft.

Ballast water is then pumped into the upper end of the second legs 43 so that they rotate counterclockwise from their position shown in FIG. 13 to that shown in FIG. 14. The rotated positions of the damper plate assembly 90 and of the second legs 43 are adjusted so that the leg ends 36 of the second legs abut the travel stops 20 of the upper pin sockets 18 of the platform. At that point, the pins 48 of the second legs can be hydraulically extended as before to fix the positions of both legs 26 and 43 to the damper plate 90. Since the leg-to-damper plate connection is rigidized and will not be changed further during assembly, the keeper pins 23 on the damper plate are screwed inwardly to engage the locking pin pockets 51 of the pin assemblies 48. Tightening of the jam nuts 24 against the threaded bosses 20 of the pin sockets 18 of the damper plate assembly 90 prevents inadvertent unlatching of the pins 48. Following this operation, the platform is configured as is shown in FIG. 14.

The last step in configuring the platform 10 to the final arrangement of its primary components is to cause the cojoined leg system 25 and the damper plate assembly 90 to perform a rigid-body rotation from the position shown in FIG. 14 to that shown in FIG. 15. Any sea fastenings which would prevent this rotation are removed preparatory to proceeding. To cause the rotation, water ballast is pumped into the ends of the second legs 43 nearest to the damper plate. Note that the damper plate 91 is free-flooding for this operation. Any valves accessing the interior of the damper plate 91 must be opened at this time to permit free flooding.

After the upper end (when in service) of the second legs 43 has rotated past the point where they are directly below the deck pin sockets 18 engaged by the pins 48 of the first legs 26, the ballast is forced in a controlled manner from the upper end of the second legs. This alteration in ballasting causes the rigidized leg-damper plate assembly to complete its rotation so that the upper ends of the second legs engage the travel stops 20 of the pin sockets 18 on the left side of the deck 11, as shown in FIG. 15. At that point, the pins 48 at the upper end of the second legs 43 are hydraulically actuated to fully latch into the pin sockets of the deck 11. The keeper pins 23 of the deck 11 are then inserted into the locking pin pockets 51 of the pins 48 and locked with the jam nuts 24.

At this point, the platform is fully assembled and can be deballasted from its final assembly position, indicated by water level 122, to its operational water level 123. At this stage, the platform is fully rigidized and seaworthy. The final setup of the platform 10, after towing it to the actual operational site, involves the running of the moorings and risers.

The assembly operations of the second embodiment 200 of the platform are identical to those of platform 10. The only structural differences are variations in the decks and damper plate assemblies due to the moving of the fairleaders 101. As stated previously for the first embodiment 10, the structure deck 201 is configured primarily for supporting its payload on its upper surface and so does not differ appreciably in its physical structure from deck 11. Only the mooring operations differ slightly for the platforms 10 and 200.

The assembly of the third platform embodiment 300, with its fairleaders 101 mounted on its corner legs, does depart slightly from the assembly procedures for embodiments 10 and 200, since the removable fairleader supports 302 have to be installed. However, platform 300 in all other respects is assembled the same way as platforms 10 and 200. Again, the mooring procedures differ slightly from those of the other two embodiments.

The removable fairleader supports 302 can be attached at any point in the assembly of platform 300 after the legs 26 and 43 have been rotated apart from their planar nested condition shown in FIG. 12. Since it is advisable to have the legs to which the removable fairleader supports 302 will be mounted stable during mating, the mating is best done best when the platform 300 is operating position corresponding to FIG. 15. However, it is also possible to perform this mating when the platform 300 is a state corresponding to that of FIG. 14. The mating is described here for the erected platform 300 as shown in FIG. 15.

A removable fairleader support 302 is suspended on cables from either a work vessel positioned along side of the platform or, better, from the deck 11 above the fairleader support mounting hubs 310 on its mounting leg. The upper surface of the support 302 supporting the fairleaders 101 is kept level for the mating. The fairleader support 302 is lowered and its attachment hubs 303 are approximately aligned with the mounting hubs 310 on the supporting leg. Attached approximately horizontal cables are then used to pull the support 302 closer to the supporting leg until the stabbing noses 304 of the attachment hubs 303 enter the bores of the mounting hubs 310, thereby inducing axial alignment for the mating. Further tensioning of the approximately horizontal attached cables causes the upset flanges of the comating hubs 303 and 310 to abut.

The final step of the mating is then to use the fairleader support latching clamps 305 to rigidly interconnect the hubs 303 and 310, thereby solidly mounting the removable fairleader support 302 to the platform 300. Following this attachment of both supports 302, the moorings may be run through the fairleaders 101 or, if desired, messenger lines can be preinstalled instead for later running of the moorings.

The installation of a platform 10, 200, or 300 with the deck 11 or 201 replaced by the second deck embodiment 400 is done in the same manner described for the other platform embodiments. Only slight changes in ballasting procedures and the need for divers or remotely operated vehicles differentiate the assembly of a platform using the second deck embodiment 400.

The assembly operations for platform 10 can be fully or partly reversed at any step of the operation, unlike the situation for all other types of floating platforms. This flexibility permits the platform to be readily salvaged, refurbished, reconfigured, or moved on a heavy lift vessel long distances to new locations. For certain situations, this ease of disassembly permits the platform 10, 200, or 300 to be initially installed and moored at an offshore field with the drilling deck 201, so that development drilling can be done for the field. When the development drilling is complete, then the platform can be unmoored and partially disassembled to its traveling condition, shown in FIG. 13. The platform can then be returned to a yard where its drilling deck 201 can be exchanged for a production deck 11 carrying a production deck payload 120. After fully inspecting and, if necessary, refurbishing the platform, it can then be returned offshore, reassembled, and reinstalled at its original moorings with the production deck.

The assembly methods for any of the platform embodiments of the present invention can be varied somewhat from those already described without departing from the spirit of the invention. For the assembly of the damper plate structure 90 to the legs, it is not required that the damper plate be lifted by cranes or other lifting means if the damper plate is not made free-flooding. For such a case, the flooding of the damper plate is controlled by utilizing selectably operable valves to control the ingress and egress of air and water from the interior of the damper plate 91. Then, for the assembly of the first legs 26 to the damper plate 91 using the field mateable pin assemblies 48, the damper plate assembly 90 is floated adjacent to the mating leg ends 36. The legs are preassembled as shown in FIG. 12 for this mating. The damper plate then is ballasted so that its mating pin sockets 18 are substantially aligned with the leg ends. The leg ends 36 can then be urged by pulling them into full alignment with the use of the travel stops 20 of the pin sockets 18. When this has been done, the pins 48 can be engaged into the bores 19 of the pin sockets 18 to establish the initial connection of the first legs 26 and the damper. Following deballasting of the damper plate, the unpinned side of the damper plate can be lifted so that the leg-damper plate combination assumes the position shown in FIG. 13.

It is also possible to use a different sequence of assembly steps to get from the towing condition of the platform 10 shown in FIG. 13 to the final assembled condition shown in FIGS. 1, 2, 3, and 15; the alternative sequence would be as follows. The first legs 26 and second legs 43 would be kept parallel in the same plane as they are rotated clockwise about the pins 48 engaged with the deck 11 with their attached damper plate assembly 90 from their starting position shown in FIG. 13. The combination boat landing and strongback 84 is used to maintain planarity of the legs during this rotation. When the legs are approximately vertical, the combination boat landing and strongback 84 is detached from the mounting hubs 42 on the second legs 43 so that the free upper end of the legs 43 can be pulled across underneath the deck 11 to be latched to the far side of the deck. Preparatorily for this, cylinder 108 of the knee brace 106 on the damper plate assembly 90 is extended so that the lower leg ends 36 of the second legs 43 will not interfere with the leg rotation. Secondary lifting lines attached to either the deck 11 or a work vessel will also be used for supporting the damper plate assembly on its free side. Keelhauled pulling lines are preattached to the leg ends 36 of the legs 43 to perform the pulling across.

Following the latching of second legs 43 to the deck 11, the damper plate is pulled vertically using the preattached secondary lifting lines and the cylinder 108, so that the final latching of the damper plate to the lower end of the second legs can be accomplished. At this point, the platform 10 is in its final assembled condition shown in FIG. 15.

The combination boat landing and strongback 84 can be attached or detached in the field when the platform is fully assembled as in FIGS. 1, 2, 3, and 15. For attachment, this would involve bringing the boat landing 84, positioned upright on a work vessel, alongside the platform 10 so that it is approximately aligned with its final position. Lifting lines from the deck and/or the legs on the intended mounting side of the platform are used to lift and vertically position the boat landing near its mounting hubs 42 on the adjacent legs. Following approximate vertical and lateral alignment, pulling lines are used to cause the stabbing noses 87 of the boat landing to align with and enter the bores of their comating mounting hubs 42. After the upset flanges of the mounting hubs 86 of the boat landing 84 and the mounting hubs 42 of the legs are abutted, the connection process is completed by installing boat landing latching clamps 88. Removal involves the reversal of the process just described.

As will readily be understood by those skilled in the art, a variety of substitutions or alterations in the invention could be made without departing from the spirit of the present invention. For instance, the number of leg pairs could be varied from two pairs to four pairs or more. Likewise, the geometry of the leg cross-sections and leg structure, the damper plate assembly, or the deck structure could be altered. The strongback or multiple strongbacks could be placed in different locations, including on the bottom rather than the top of the legs as shown in FIG. 12. Other construction and fabrication and assembly aids or arrangements besides the ones mentioned herein could also be used. Different seals could be used on the pins of the field mateable pin assemblies, and the cylinders could be of the passive self-locking type. None of these changes would depart from the spirit of the invention.

ADVANTAGES OF THE INVENTION

The inclined leg floating production platform 10 of the present invention offers a number of substantial improvements over the existing technology used for deepwater petroleum production platforms. While offering comparable seakeeping behavior to competitive platform designs having ultradeep drafts such as spars and the EDP, the crossed and inclined arrangement of the buoyant legs minimizes or eliminates the tendency of the platform to lateral vibrations in a current due to vortex shedding (vortex-induced vibration or VIV). Considerable fatigue damage can occur to catenary pipeline risers at their touchdown points on the seabed from vessel motions due to vortex-induced vibrations. Similarly, fatigue damage to chain moorings can result from VIV. In contrast to the present invention, vortex-induced vibration is a major problem for other ultradeep production structures that have vertical buoyancy members, such as spars, semisubmersibles, and the extendable draft platform (EDP).

One primary advantage for the inclined leg floating production platform is its relatively low cost of construction and installation. This low cost arises from several factors. Other than requiring machining of some large parts, the fabrication is conventional shipyard construction. The deck section 11 is largely built in a pattern typical of a large barge. The legs 26 and 43 are also conventional shipyard construction and can be built at typical shipyard or platform fabrication locations or even grass-roots locations. Roll-formed and press-broken plate construction is generally very inexpensive in a shipyard. Likewise, the damper plate assembly 90 can readily be built in a conventional shipyard. Many critical subassemblies, such as the pin sockets 18 that require more precision or machining can be jobbed out to specialized shops. The construction of these items does not require very large cranes for high lifts or unusually heavy lifts, in contrast to the other types of platform.

The construction of the components can be done near ground level and then the components can be dragged, skidded, launched, or otherwise moved to the water. After the hull of the deck section is completed, the fitting out of the deck section with its marine equipment and production equipment can all be done at low level at dockside, which results in considerable savings. This is in contrast to the very heavy offshore lifts requiring a very large derrick barge and the subsequent field hook up needed for a spar. The shipyard or construction facility does not need to have a deep berth or deep channel in order to accommodate the fabricated parts. Likewise, the relatively very low towing height of the platform 10 permits it to be towed in channels with overhead height restrictions.

Alternatively, the major components (i.e., the legs 26 and 43, the deck 11, and the damper plate 91) can be fabricated at different locations and then brought to the final sheltered water preassembly point to be coupled as shown in FIG. 15. The legs can be towed readily either individually, in pinned pairs, or in the cross-braced complete set of legs 25, as shown in FIG. 12. For transporting the legs as a complete leg system 25, the damper plate assembly 90 can be either attached or unattached. Likewise, the deck can be towed as a barge. All of the major components can be moved individually or together on a heavy lift vessel. This flexibility greatly reduces construction costs and permits the platform components to be built at the most economical location.

Additionally, substructures of the deck structure 11 and damper plate assembly 90 can be built in a preassembled condition with the leg systems 25 in order to ensure proper fit. The substructures can then be separated and then combined with the main portion of their structure so that the fit up is assured in the field. This advantage eliminates considerable uncertainty in the assembly of the structural components.

Preassembly of the deck structure 11 to the leg systems 25 can be done in quiet, shallow water with those components afloat when the legs are ballasted into position, and the process can be assisted by provision of temporary and/or permanent location aids, such as the travel stop 20. Several smaller cranes can be used to manipulate the damper plate assembly 90 when it is positioned for its initial attachment to the leg systems 25, as shown in FIG. 12. Large cranes also are not required for the balance of the assembly done in deep water, as shown in FIGS. 14 and 15.

The use of the hinged inclined legs and the pinned final assembly permit the inclined leg floating production platform to use different construction procedures than have been used previously, thereby leading to considerable savings. Use of the damper plate, combined with the inclined legs, leads to improved seakeeping and hydrodynamic (VIV) properties. The seakeeping response of the platform can be tuned by varying damper plate depth and size and leg spacing near the waterline, so that the platform can be optimized for different wave regimes in different parts of the world. These and other advantages will be obvious to those skilled in the art. Additionally, the ability to rapidly interchange a drilling deck for a production deck while reusing the balance of the platform offers excellent economies due to time saving and construction cost savings.

It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

What is claimed is:

1. A floating offshore platform comprising:

a buoyant deck;

a plurality of pairs of crossed legs, wherein each pair of crossed legs includes a first leg inclined in a first direction and a second leg inclined in a second opposed direction;

a pivot pin cojoining the first and second leg of each pair of crossed legs at a point where the first and second legs cross each other;

a first attachment means for attaching a first end of each leg in the pair of crossed legs to the deck;

a submersible damper plate;

a second attachment means for attaching a second end of each leg in the pair of crossed legs to the damper plate; and a pair of rigid diagonal leg braces connecting two adjacent pairs of crossed legs.

2. The platform of claim 1, wherein the first leg of each pair of crossed legs is parallel to the first leg of every other pair of crossed legs and the second leg of each pair of crossed legs is parallel to the second leg of every other pair of crossed legs and wherein the pivot pins joining the pairs of crossed legs are coaxial to each other.

3. The platform of claim 1 having three pairs of crossed legs.

4. The platform of claim 3, wherein the deck interconnects the first ends of the first legs in a first coaxial array and the first ends of the second legs in a second coaxial array, wherein the first coaxial array and the second coaxial array are on opposed sides on the deck and are parallel.

5. The platform of claim 4, wherein the damper plate interconnects the second ends of the first legs in a third coaxial array and the second ends of the second legs in a fourth coaxial array, wherein the third coaxial array and the fourth coaxial array are on opposed sides of the damper plate and are parallel.

6. The platform of claim 1, further comprising a boat landing mounted to and interconnecting the first legs of the pairs of crossed legs.

7. The platform of claim 1, wherein the first attachment means includes a plurality of field mateable pin sockets attached to the deck and a mateable pin leg end on the first end of each leg, each pin leg end having a pair of coaxial, opposed pins that are selectably reciprocable between a first position and a second position, wherein whenever the pins are in the first position the pins are engaged in the pin sockets and whenever the pins are in the second position the pins are disengaged from the pin sockets.

8. The platform of claim 1, wherein the second attachment means includes a plurality of field mateable pin sockets attached to the damper plate and a mateable pin leg end on the second end of each leg, each pin leg end having a pair of coaxially opposed pins that are selectably reciprocable between a first position and a second position, wherein whenever the pins are in the first position the pins are engaged in the pin sockets and whenever the pins are in the second position the pins are disengaged from the pin sockets.

9. The platform of claim 1, further comprising a plurality of mooring fairleader supports, wherein each fairleader support is mounted to the first or second leg of a crossed leg pair.

10. The platform of claim 9, further comprising a mooring fairleader swivable about a vertical axis.

11. A method for disassembling the floating oilfield platform of claim 1 comprising:

detaching the first legs of the plurality of cojoined crossed leg pairs from a platform deck;

detaching the second legs of the plurality of cojoined crossed leg pairs from the platform deck; and detaching the first legs and the second legs from the damper plate.

12. A method for exchanging a floating platform deck of the floating oil platform of claim 1, the method comprising:

detaching the first legs of the plurality of cojoined crossed leg pairs from a first buoyant deck;

detaching the second legs of the plurality of cojoined crossed leg pairs from the first buoyant deck;

attaching the set of first legs to a second buoyant deck; and attaching the set of second legs to the second buoyant deck.

13. A floating oilfield platform comprising:

a buoyant deck mounting multiple pairs of deck pin sockets, each pair of deck pin sockets includes a first deck pin socket having a first deck bore and a second deck pin socket having a second deck bore, wherein the first deck pin sockets are mounted on a first side of the deck with coaxially aligned first deck bores and the second deck pin sockets are mounted on a second opposed side of the deck with coaxially aligned second deck bores;

a plurality of leg pairs having a first leg and a second leg cojoined by a pivot pin, wherein the pivot pins of the leg pairs are coaxial;

at least one first rigidized diagonal brace interconnecting the first legs of the leg pairs and at least one second rigidized diagonal brace interconnecting the second legs of the leg pairs;

a submersible damper plate mounting multiple pairs of damper pin sockets, each pair of damper pin sockets includes a first damper pin socket having a first damper bore and a second damper pin socket having a second damper bore, wherein the first damper pin sockets are mounted on a first side of the damper plate with coaxially aligned first damper bores and the second damper pin sockets are mounted on a second opposed side of the damper plate with coaxially aligned second damper bores; and a plurality of selectably extendable pins, a pair of extendable pin mounted on a top end and a bottom end of each first and second leg of each leg pair, wherein the extended extendable pins engage the first and second deck bores and the first and second damper bores.

14. The platform of claim 13, wherein the first deck pin sockets are mounted in a first coaxial array on the first side of the deck and the second deck pin sockets are mounted in a second coaxial array of the second side of the deck and the first coaxial array is parallel to the second coaxial array.

15. The platform of claim 13, wherein the first leg is inclined in a first direction and the second leg is inclined in a second opposed direction and wherein the first leg and the second leg of each leg pair are cojoined by the pivot pin at a point intermediate to the top end and the bottom end of the first and second legs.

16. The platform of claim 13, wherein the deck has a first lateral pin mounting surface on the first side of the deck and a second lateral pin mounting surface on the second side of the deck, wherein the first deck pin sockets are mounted on the first pin mounting surface and the second deck pin sockets are mounted on the second pin mounting surface.

17. The platform of claim 13, wherein the deck has a first well bay and the damper plate has a second well bay, the first well bay being vertically aligned with the second well bay.

18. The platform of claim 13, further comprising a travel stop mounted on each of the first and second deck pin sockets.

19. The platform of claim 13, further comprising a travel stop mounted on each of the first and second damper pin sockets.

20. The platform of claim 13, wherein the extendable pins mounted to the top ends of the first legs of the leg pairs are interconnected to the deck pin sockets on the first side of the deck and the extendable pins mounted to the top ends of the second legs of the leg pairs are interconnected to the deck pin sockets on the second side of the deck.

21. The platform of claim 20, wherein the first leg and the second leg are inclined at opposed angles from the vertical.

22. The platform of claim 13, wherein the first leg and the second leg are rotatable about the pivot pin.

23. The platform of claim 13, wherein the first and second legs of the leg pairs are offset in the direction of the pivot pin whereby the first and second legs are rotatable to a parallel position.

24. The platform of claim 13, wherein the first legs of the leg pairs are coplanar in a common plane containing the axis of the pivot pin.

25. The platform of claim 13, wherein the second legs of the leg pairs are coplanar in a common plane containing the axis of the pivot pin.

26. The platform of claim 13, wherein the first legs and the second legs of the leg pairs are in planes intersecting on the axis of the pivot pins.

27. The platform of claim 13, wherein the diagonal braces maintain the first legs mutually parallel and the second legs mutually parallel.

28. The platform of claim 13, wherein the pins are reciprocable between a first extended position engaging the deck bores and damper bores and a second retracted position that disengages the pins from the deck bores and damper bores.

29. The platform of claim 13, wherein the extendable pins mounted to the bottom ends of the first legs of the leg pairs are interconnected to the damper pin sockets on the second side of the damper plate and the extendable pins mounted to the bottom ends of the second legs of the leg pairs are interconnected to the pin sockets on the first side of the damper plate.

30. The platform of claim 13, wherein the elevation of the deck is controlled by adjusting the buoyancy of the leg pairs.

31. The platform of claim 13, further comprising a plurality of hubs mounted in a spaced apart parallel pattern on at least one leg, wherein each hub has an outwardly upset transverse hub flange and a hub bore;

a rigid attachment structure having a plurality of stabbing noses mounted in a spaced apart parallel pattern corresponding to the spaced apart parallel pattern of the hubs, wherein each stabbing nose is mateable with the corresponding hub bore and each stabbing nose has an outwardly upset transverse attachment flange, wherein each attachment flange is flush with the corresponding hub flange whenever the attachment flange and the hub flange are abutted; and a split clamp engageable with each hub flange and attachment flange whenever the attachment flange and the hub flange are abutted.

32. The platform of claim 31, wherein the attachment structure is a boat landing.

33. The platform of claim 31, wherein the attachment structure is a strongback.

34. The platform of claim 31, wherein the attachment structure is a mooring fairleader support.

35. The platform of claim 13, further comprising a boat landing mounted to and interconnecting adjacent first legs of the leg pairs.

36. The platform of claim 13, further comprising a mooring fairleader support selectably installable on at least one first or second leg of the platform.

37. The platform of claim 36, further comprising a fairleader mounted on the fairleader support.

38. The platform of claim 13, further comprising a pipeline guiding tube mounted on at least one first leg of the platform, wherein the pipeline guiding tube has a bore sized to house a pipeline within the bore.

39. The platform of claim 13, further comprising a pipeline anchor receptacle.

40. The platform of claim 13, wherein each deck pin socket includes a keeper pin interlocking the deck pin socket with the engaged extendable pin.

41. A floating oilfield platform stabilized using a rigidized four bar linkage, the four bar linkage comprising:

a deck serving as a first link;

a damper plate serving as a second link; and a set of crossed leg pairs having a first leg inclined in a first direction and a second leg inclined in a second opposed direction, wherein the first leg and the second leg are cojoined by a pivot pin where the first leg crosses the second leg, the first leg serving as a third link and the second leg serving as a fourth link;

where a proximal end of each first leg is attached to a first side of the deck and a proximal end of each second leg of the cojoined leg pairs is attached to a second side of the deck and where a distal end of each first leg is attached to a second side of the damper plate and a distal end of each second leg of the cojoined leg pairs is attached to a first side of the damper plate and whereby the four bar linkage is rigidized by the pivot pin cojoining the first leg and the second leg.

42. A method for assembling a floating oilfield platform comprising:

obtaining a plurality of platform leg pairs, wherein each leg pair is comprised of a first platform leg cojoined to a second platform leg by a pivot pin;

attaching a proximal end of each first leg of the platform leg pairs to a first side of a floating platform deck;

attaching a distal end of each first leg of the platform leg pairs to a first side of a damper plate;

rotating the attached cojoined leg pairs underneath the platform deck;

attaching a proximal end of each second leg of the platform leg pairs to a second side of the deck; and attaching a distal end of each second leg of the platform leg pairs to a second side of the damper plate, wherein the first leg is inclined in a first direction and the second leg is inclined in a second opposed direction and the first leg crosses the second leg at a point where the first leg is cojoined to the second leg; and elevating the deck to a desired height above a water surface by controlling the buoyancy of the platform leg pairs.

43. A method for assembling a floating oilfield platform comprising:

obtaining a plurality of buoyant platform leg pairs, wherein the leg pair comprises a first platform leg cojoined to a second platform leg by a pivot pin, the first leg being cojoined to the second leg at a point intermediate between a distal end and a proximal end of the first leg and the second leg being cojoined to the first leg at a point intermediate between a distal end and a proximal end of the second leg;

attaching the distal end of each first leg of the platform leg pairs to a first side of a damper plate;

attaching the proximal end of each first leg of the platform leg pairs to the first side of a floating platform deck;

attaching the distal end of each second leg of the platform leg pairs to a second opposed side of the damper plate;

rotating the damper plate and the attached platform legs underneath the platform deck; and attaching a proximal end of each second leg of the platform leg pairs to a second opposed side of the deck;

wherein each platform leg pair of the assembled platform has the first leg inclined in one direction and the second leg inclined in a second opposed direction and whereby the first leg crosses the second leg where the first and second legs are cojoined by the pivot pin.

44. A method for assembling a floating oilfield platform comprising:

inserting a selectably extendable pin assembly into a proximal end and a distal end of a plurality of legs;

positioning a first leg and a second leg parallel to each other;

joining the first and the second legs with a pivot pin to form a cojoined leg pair, wherein the first and second legs are rotatable about the pivot pin;

positioning a plurality of cojoined leg pairs, wherein the first legs of the leg pairs are parallel and the second legs of the leg pair are parallel and the extendable pin assemblies in the proximal ends and the distal ends of the parallel first legs are axially aligned and the extendable pin assemblies in the proximal ends and the distal ends of the parallel second legs are axially aligned and the pivot pins are coaxial;

securing a first brace to each adjacent pair of the parallel first legs;

securing a second brace to each adjacent pair of the parallel second legs;

attaching the distal ends of the braced parallel first legs to a first set of damper pin sockets mounted on a first side of a damper plate by extending the pin assemblies in the distal ends of the first legs into a first set of coaxially aligned through-bores of the first set of damper pin sockets;

attaching the proximal ends of the braced parallel first legs to a first set of deck pin sockets mounted on a first side of a deck by extending the pin assemblies in the proximal ends of the first legs into a first set of coaxially aligned through-bores of the first set of deck pin sockets;

pivoting the braced parallel second legs to angularly separate the braced parallel second legs from the braced parallel first legs;

attaching the distal ends of the braced parallel second legs to a second set of damper pin sockets mounted on a second opposed side of the damper plate by extending the pin assemblies in the distal ends of the second legs into a second set of coaxially aligned through-bores of the second set of damper pin sockets;

rotating the damper plate and attached leg pairs underneath the deck;

aligning the proximal ends of the braced parallel second legs with a second set of deck pin sockets mounted on a second opposed side of the deck; and attaching the proximal ends of the braced parallel second legs to the second set of deck pin sockets by extending the pin assemblies in the proximal ends of the second legs into a second set of coaxially aligned through-bores of the second set of deck pin sockets;

whereby the braced parallel first legs and the braced parallel second legs are inclined at opposed angles from a vertical plane through the pivot pins of the cojoined leg pairs.

45. The method of claim 44, further comprising the step of mounting a keeper ring on a first end and a second end of the pivot pin.

46. The method of claim 44, further comprising the step of attaching a strongback to the braced parallel first legs to interconnect the braced parallel first legs and to the second legs prior to pivoting the second legs relative to the first legs.

* * * * *